United States Patent [19]

Utsumi et al.

[11] 4,290,041

[45] Sep. 15, 1981

[54] VOLTAGE DEPENDENT NONLINEAR RESISTOR

[75] Inventors: Kazuaki Utsumi; Nobuaki Shohata; Tomeji Ohno, all of Tokyo, Japan

[73] Assignee: Nippon Electric Co., Ltd., Tokyo, Japan

[21] Appl. No.: 9,777

[22] Filed: Feb. 6, 1979

[30] Foreign Application Priority Data

Feb. 10, 1978 [JP] Japan ..... 53/14238

[51] Int. Cl.[3] ..... H01C 7/10

[52] U.S. Cl. ..... 338/21; 338/324

[58] Field of Search ..... 338/20, 21, 322, 324, 338/325, 332; 252/518, 521; 29/610, 621; 361/127

[56] References Cited

U.S. PATENT DOCUMENTS

| | | | |
|---|---|---|---|
| 2,707,223 | 4/1955 | Hollmann | 338/20 X |
| 3,754,200 | 8/1973 | Harnden | 338/20 |
| 3,764,951 | 10/1973 | Tuchibana et al. | 338/20 |
| 3,863,111 | 1/1975 | Mantzloff | 338/21 |

OTHER PUBLICATIONS

Matsuoka, *Japanese Journal of Applied Physics,* "Nonohmic Properties of Zinc Oxide Ceramics", vol. 10, No. 6, pp. 736–746, 6/71.

*Primary Examiner*—C. L. Albritton

*Attorney, Agent, or Firm*—Laff, Whitesel & Rockman

[57] ABSTRACT

A "varistor" or voltage-dependent nonlinear resistor employs a ceramic base body having a voltage-dependent nonlinearity. First and second lead-out electrode layers are formed on first and second external surfaces, respectively, of the ceramic base body. Within and enclosed by the ceramic base body, a plurality of internal electrodes extend in parallel with each other and connect to the external lead-out electrodes. Also, the invention provides a method of manufacturing the voltage-dependent nonlinear resistor comprising the steps of forming a plurality of raw sheets of material, each having the desired voltage-dependent nonlinearity characteristics, after sintering. Internal electrodes of conducting material are printed on each of these sheets. The sheets are then laminated, cut and formed with external electrodes connecting the internal electrode to each other.

11 Claims, 30 Drawing Figures

VOLTAGE DEPENDENT NONLINEAR RESISTOR

FIELD OF THE INVENTION

The present invention relates to voltage-dependent nonlinear resistors, and more particularly to voltage-dependent non-linear resistors of a laminated type having the structure in which a plurality of electrodes made of metallic material are embedded within a sintered body.

BACKGROUND OF THE INVENTION

Voltage-dependent nonlinear resistors (hereinafter called "varistors") have been widely used as surge absorbing elements, arresters, voltage stabilizer elements, etc. Their electric characteristics are represented by the following empirical formula:

$$I/i=(V/Vi)^{\alpha} \quad (1)$$

where I represents a current flowing through the element, V represents a voltage applied across the element, and Vi represents a voltage when the current value is i amperes. Normally, the value of Vi is selected to give a current value of 1 mA and is called the "rise-up voltage," Vima. The factor $\alpha$ is called a "nonlinearity coefficient," which indicates how a voltage of an electric circuit having a varistor inserted therein can be controlled. The larger the value of $\alpha$ is, the more excellent the voltage control characteristics are. Accordingly, except for a special use, varistors having a larger value of this coefficient are desirable. The value of Vi is determined depending upon the voltage which is to be used, and it is desirable that these values can be regulated, respectively, to given values.

DESCRIPTION OF THE PRIOR ART

Heretofore, SiC varistors, Si Varistors, Se rectifiers, copper suboxide rectifiers, germanium or silicon rectifiers, etc. have been used for the above-mentioned purposes. However, these varistors or rectifiers had many shortcomings such that the voltage-dependent nonlinearity constant $\alpha$ is small. The value of Vi cannot be regulated arbitrarily. The shape cannot be made small. The power loading durability or the ability to withstand current surges is poor. The manufacture is difficult and expensive, or the like, and hence their use was limited. Recently, oxide varistors, principally composed of zinc oxide (ZnO), have been developed to reduce these shortcomings. The details of this development are disclosed, for example, in an article by M. Matsuoka entitled "Nonohmic Properties of Zinc Oxide Ceramics" published in the Japanese Journal of Applied Physies, Vol. 10, No. 6, June 1971, pp. 736–746 or in U.S. Pat. No. 3,962,144.

Since this varistor has an excellent voltage-dependent nonlinearity coefficient, its use is being expanded. However, in the prior art, it is still unsatisfactory as an electric circuits element for use in a highly advanced communication instrument, or the like.

In more particular, in the case of the zinc oxide varistor in the prior art, it was difficult to lower the value of $V_{1mA}$ to 50 V or less. In order to obtain a low value of $V_{1mA}$, there is no way other than raising a sintering temperature or reducing a thickness of a base body. If a sintering temperature is raised, there is a problem since ZnO and additives are evaporated and, thereby, the characteristics of a varistor are lost, or the varistor elements are fused together upon sintering. Practically, 1400° C., is the upper temperature limit that can be used and the method of raising the sintering temperature is limited. On the other hand, with regard to the method of reducing the thickness of the varistor element, a thickness of 0.3 mm is the lower practical limit.

Normally, a manufacture of varistors employs the steps of pressing an element having a predetermined thickness and sintering the same, and in order to maintain a rise-up voltage within ±10% with respect to a predetermined value, it is also necessary to keep the precision of thickness within at least 10%. It is very difficult to press-shape an element having a uniform thickness of 0.3 mm or less at a precision of 10% or less. It will greatly degrade the manufacturing yield. In addition, upon sintering an element that is as thin as about 0.3 mm in thickness, the evaporation of ZnO and additives from the surface of the element cannot be disregarded even at a temperature of about 1200° C. Sometimes, it may happen that a sufficiently good property cannot be obtained. Furthermore, in the case of an element having a thickness of 0.3 mm or less, the element is apt to be broken upon manufacture or upon use. In addition, depending upon the treatment when baking electrodes are applied thereto, it may also happen that the surface layer changes its properties and performance or stability is degraded. Therefore, it is not desirable to make the element too thin.

In the method of cutting after sintering, and then grinding, a similar situation may also arise. Further, the surface layer of the element changes in properties due to grinding or that due to a dropping of particles from the surface, is liable to increase a leakage current and cause a fall of the coefficient $\alpha$. Therefore, it is difficult to lower the rise-up voltage $V_{1mA}$ by making the element thin through cutting and grinding.

Another type of voltage-dependent nonlinear resistors, having a low rise-up voltage $V_{1mA}$, make use of a surface potential barrier between a base body presenting no nonlinearity and an electrode. However, they cannot be practically used because they have associated problems such that the value of the rise-up voltage $V_{1mA}$ cannot be regulated arbitrarily, the coefficient $\alpha$ is as small as 10 or less, and they lack reproducibility and stability of performance.

On the other hand, different examples of voltage-dependent nonlinear resistors having a rise-up voltage $V_{1mA}$ of 50 V or less and a large coefficient $\alpha$ whose rise-up voltage can be regulated arbitrarily are germanium or silicon rectifiers called Zener diodes. These elements present asymmetric voltage-dependent nonlinearity. Hence in order to form an element having symmetric varistor characteristics, it is necessary to connect two such elements in opposite directions. In addition, since they are relatively weak under a surge current, in order to increase a durable amount of surge, it is necessary to make the element have a large area, so that the shape of the element becomes large and also the cost becomes inevitably expensive.

In addition, not only the values of $\alpha$ and $V_i$, but also a value of a leakage current $i_R$ is important. In a case where a varistor is used for the purpose of protecting from an excessive voltage, it is a common practice to use a varistor having a rise-up voltage which is about 1.6 times as high as a circuit voltage. In the case of such a mode of use, it is desired that normally a leakage current as small as possible can flow through the varistor. Practically, it is advantageous to define the leakage current by a current value at a voltage equal to 60% of $V_i$, and preferably this current value should be 1 $\mu$A or less.

Still further, if a varistor is used as a constant voltage element by making use of its sharp current rise-up characteristics, it is used under a condition applied with a constant power load. The varistors in the prior art had a shortcoming that if a constant power load is applied for a long period, a rise-up voltage changes to a lower voltage side and a leakage current also increases. Accordingly, in such a use, the excellent voltage dependent nonlinearity of varistors could not be maintained.

Also temperature caused changes of the rise-up voltage was large and hence served as a bar for practical use.

With regard to ceramic varistors of the laminated type, in the prior art, they have such a structure that a pair of internal electrodes are formed on front and rear surfaces of a preliminarily sintered varistor element (a sintered body). Such elements are piled with electrodes applied thereto so as to connect the respective elements in parallel. Besides the ends of the lead-out portions of the internal varistor electrodes are exposed externally, that is, on the side surfaces which are at right angles to the side surfaces for leading out the internal electrodes. For the purpose of protecting these exposed portions and bonding of the varistor elements, the surface of the assembly is coated with an organic material such as a binder or a outer coating resin.

Accordingly, the varistors of the laminated type, in the prior art, had shortcomings since the value of $V_{1mA}$ cannot be made small due to limitations of the sintering temperature and the thickness. According to the knowledge obtained by a humidity withstand test and a high temperature loading test, the performance of the element is liable to deteriorate due to penetration of water into the interstices between the ceramic portions and the organic material and due to a change in nature of the organic material, and hence the reliability of the element is degraded.

SUMMARY OF THE INVENTION

It is an object of the present invention to provide a voltage dependent nonlinear resistor which is free from the above-described various shortcomings, and which is compact and is excellent in voltage-dependent nonlinearity, leakage current characteristics, power load withstanding characteristics and surge withstanding characteristics.

Another object of the present invention is to provide a voltage-dependent nonlinear resistor of a laminated type having a rise-up voltage $V_i$ which can be regulated to any arbitrary value which is equal to or higher than 4 V, by varying an elementary layer thickness of an element between electrodes.

According to one feature of the present invention, a voltage-dependent nonlinear resistor comprises a sintered body having a voltage-dependent nonlinearity resistance and a plurality of internal electrodes embedded within the sintered body except for the portions led out externally.

According to another feature of the present invention, a voltage-dependent nonlinear resistor comprises a ceramic base body which presents voltage-dependent nonlinearity resistance, a first external lead-out electrode layer is provided on a first surface of the ceramic base body, a second external lead-out electrode layer is provided on a second surface of said ceramic base body, a plurality of first internal electrodes extend within the ceramic base body in parallel to each other and are connected to the first external lead-out electrode layer. A plurality of second internal electrodes extend within the ceramic base body between the first internal electrodes in parallel to each other and are connected to the second external lead-out electrode layer. Portions of the first and second internal electrodes, other than portions connected to the first and second external electrode layers, respectively, are enclosed by the ceramic base body which is continuously formed.

According to another aspect of the present invention, a method for producing the voltage-dependent nonlinear resistor comprises the steps of forming a plurality of raw or green sheets of materials which have a voltage-dependent nonlinearity characteristics after sintering, printing an internal electrode on each raw-sheet, laminating the raw-sheets, cutting the laminated structure, sintering the cut pieces, and forming external electrodes for connecting the internal electrodes to each other.

DETAILED DESCRIPTION OF THE PRIOR ART

Figure 1:
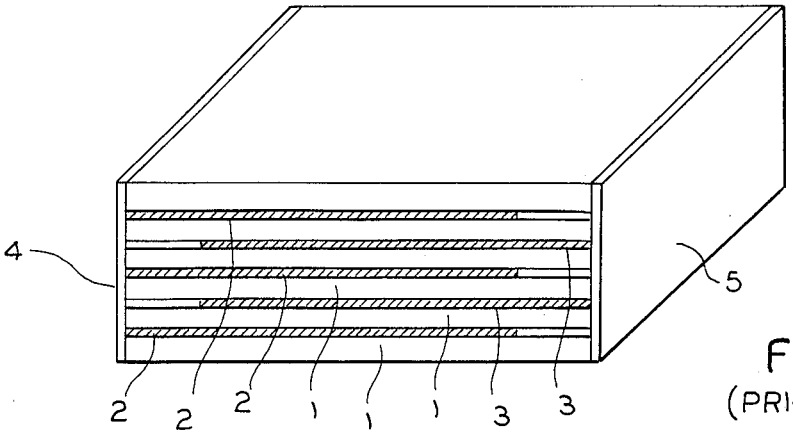
FIG. 1 (PRIOR ART)
FIG. 1 is a perspective view of a voltage-dependent nonlinear resistor in the prior art.

A voltage-dependent resistor from the prior art is illustrated in FIG. 1. Internal electrodes 2 and 3 are formed on front and rear surfaces of a sintered body 1, which has completed sintering. These sintered bodies 1 are piled upon each other and bonded together with a binder. External lead out electrodes 4 and 5 are formed to be connected to the internal electrodes 2 and 3, respectively. As will be seen from FIG. 1, the side surfaces, where the electrodes 4 and 5 are not formed, have exposed end portions of the internal electrodes 2 and 3. Thereafter, the surface of the assembly is coated with an organic material such as an external coating resin or the like.

DESCRIPTION OF PREFERRED EMBODIMENTS

Figure 2A:
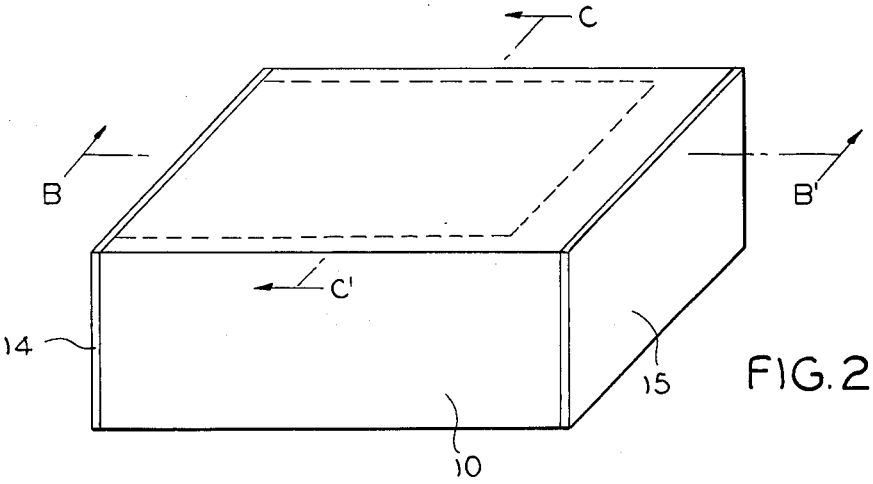
FIG. 2A is a perspective view used for explaining the outline of the present invention.
Figure 2B:
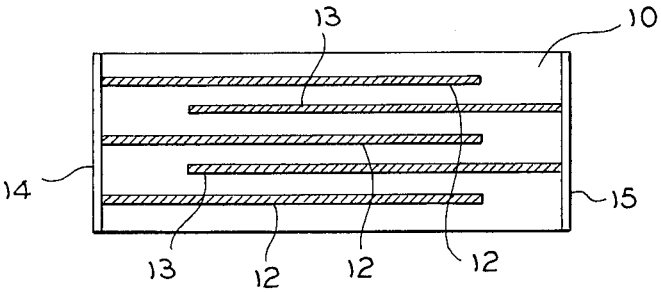
FIGS. 2B and 2C are cross-sectional views taken along lines B—B′ and C—C′, respectively, in FIG. 2A, as viewed in the direction of arrows.
Figure 2C:
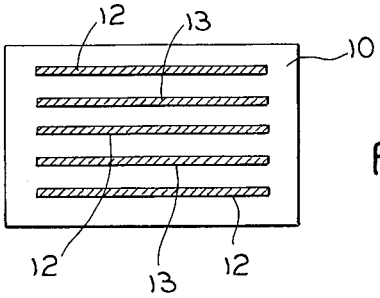

An outline of a laminated ceramic varistor according to the present invention is illustrated in FIGS. 2A, 2B and 2C. This laminated ceramic varistor has such a structure that all internal electrodes 12 and 13 are embedded within a ceramic body 10 having varistor characteristics of the electrodes except for the portions which are to be connected to external lead out electrodes 14 and 15. The internal electrodes are enclosed only by the same integrated sintered body 10. The above-described deterioration of characteristics which increase $i_R$ or reduce $\alpha$ caused by penetration of water or change in nature of the external coating resin and the binder, would not occur, and thus the varistor has excellent reliability.

EMBODIMENT 1

Next a process for the manufacture of a laminated ceramic varistor according to a first preferred embodiment of the present invention will be shown as compared to a process for manufacture of a similar varistor in the prior art. The varistor is formed by piling and bonding sintered unit plates (hereinafter called "unit plate product") as taught in TABLE 1.

TABLE 1

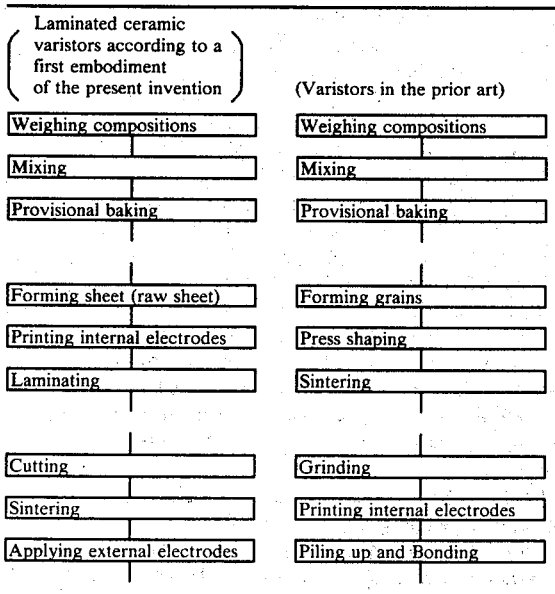

TABLE 1-continued

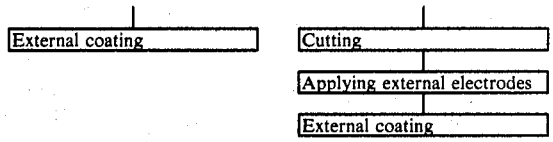

As a starting raw material, a mixture of zinc oxide (ZnO) having a purity of 99% or higher, cobalt oxide (CoO), manganese oxide ($MnO_2$), antimony oxide ($Sb_2O_3$), chromium oxide ($Cr_2O_3$) and lead zinc borosilicate glass powder having composition A in TABLE 12 was used. These respective oxides were mixed in the proportions shown in TABLE 2. Further, lead zinc borosilicate in the weight percent with respect to the total weight of the oxides given in the same table was added to this mixture. They were mixed, with the aid of pure water, in a ball mill for 36 hours. Next, the mixture was filtered and dried, and then it is provisionally baked at 600°~850° C., for 2 hours.

Figure 3A:
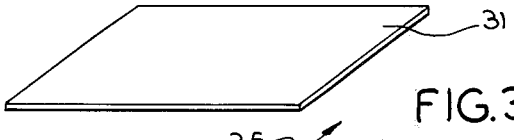
FIGS. 3A through 3F are perspective views showing successive steps in the manufacture of a first preferred embodiment of the present invention.
Figure 3B:
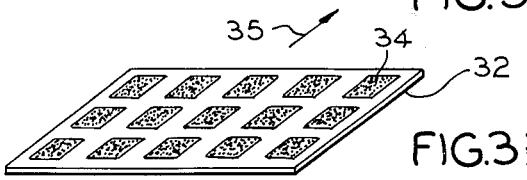

After the provisional baking, the mixture was again ground into powder and was dispersed together with an organic binder in a solvent, into a slurry state. A doctor blade formed this slurry into a uniform raw or green sheet having a predetermined thickness such as, for example, 10μ~1000μ. This raw or green sheet was stamped into rectangles of 60 mm×40 mm to form raw sheet pieces 31 (FIG. 3A). Subsequently, gold, platinum, palladium, silver or an alloy consisting of two kinds of metals, selected from these metals, was prepared in a paste state. A plurality of internal electrodes 34 were printed on this raw sheet piece 31 with the metal paste applied through a screen printing process as shown in FIG. 3B. A raw sheet piece 32 was thus obtained, having internal electrodes printed thereon.

Figure 3E:
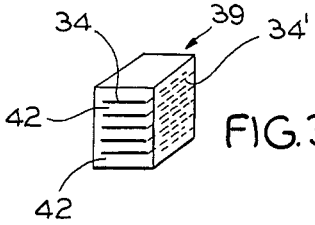
Figure 3F:
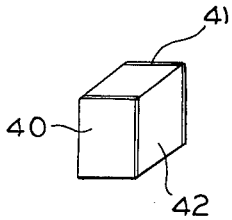
Figure 3C:
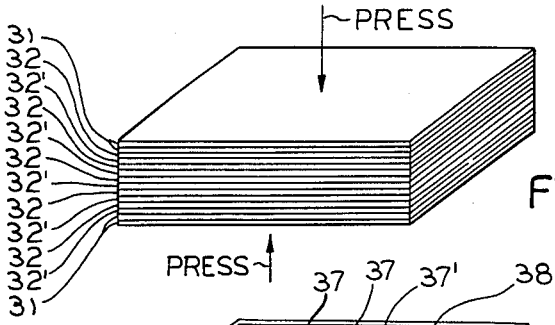

In addition, in order to alternately lead out the internal electrodes, through the opposite sides of the laminated assembly as shown in FIG. 2, different raw sheet pieces 32' (FIG. 3C) (not shown in detail) were prepared. These sheet pieces 32' had internal electrodes 34 printed thereon. The electrodes on each sheet were shifted by 1 mm in the direction of arrow 35, with respect to the raw sheet piece 31. The internal electrodes on this raw sheet piece 32' is designated by numeral 34' (FIG. 3E). Next, five raw sheets pieces 32 and five raw sheet pieces 32', each having the internal electrodes printed thereon, that is, ten raw sheet pieces in total, were alternately laminated. Further, two to four raw sheet pieces 31 without internal electrodes printed thereon were superposed above and under the laminated assembly. Then, as shown in FIG. 3C, the final laminated assembly was pressed under a pressure of 50~150 Kg/cm$^2$ applied in the directions of the arrows at a temperature of 50° C.~150° C. During this press operation, a jig was applied tightly, covering over the entire side surfaces of the laminated assembly.

Figure 3D:
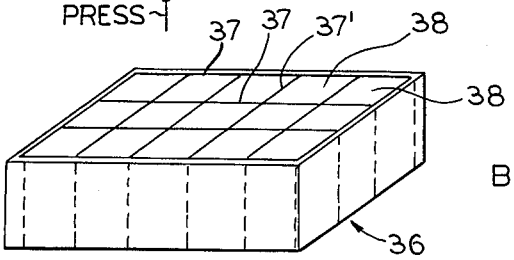

Through the above-mentioned process, an assmbly 36 was obtained having internal electrodes 34 and 34' embedded within an unsintered integrated ceramic body. By cutting this assembly, with a cutter along cutting lines 37 and 37' as shown in FIG. 3D, a raw chip 38 having internal electrodes 34 and 34' (five electrodes 34 and five electrodes 34' for each chip, or a total of ten electrodes) within an integrated raw sheet piece could be obtained. Upon this cutting, the cutting lines 37 were located exactly at the positions where the ends of the internal electrodes 34 and 34' were exposed. On the other hand, the cutting lines 37' were located at the center positions between the internal electrodes.

Then, this raw chip 38 was sintered for one hour at a temperature of 950° C.~1300° C., to produce a sintered chip 39 having internal electrodes 34 and 34' enclosed by a sintered body 42 as shown in FIG. 3E. Subsequently, silver paste electrode was applied to the side surface of the sintered body 42 where the ends of the five internal electrodes 34 were exposed and to the opposing side surface where the five internal electrodes 34' were exposed. Then the resulting structure was baked at 600° C., and thereby external lead out electrodes 40 and 41 were formed as shown in FIG. 3F.

Figure 4A:
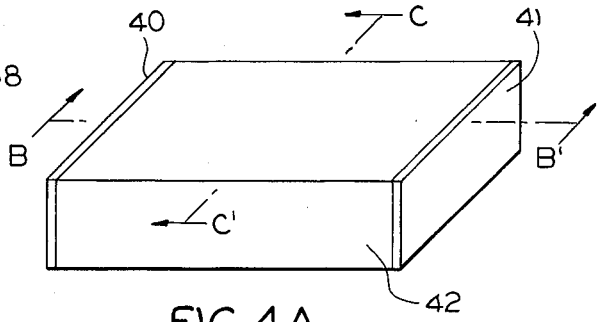
FIG. 4A is a perspective view showing a first preferred embodiment of the present invention.
Figure 4B:
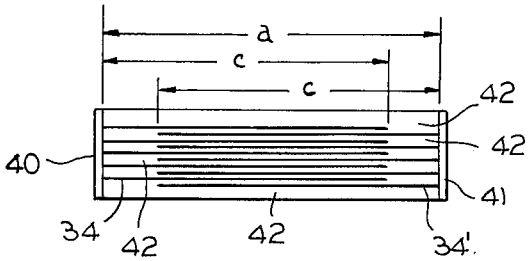
FIGS. 4B and 4C are cross-sectional views taken along line B—B′ and C—C′, respectively, in FIG. 4A, as viewed in the direction of arrows, FIG. 4C′ is an enlarged cross-section view showing the portion encircled by line C′ in FIG. 4C, FIGS. 5 through 8 are diagrams showing the characteristics of the first preferred embodiment of the present invention, as compared with the corresponding characteristics of the prior art.
Figure 4C:
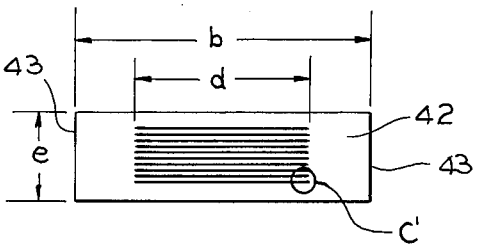
Figure 4C:
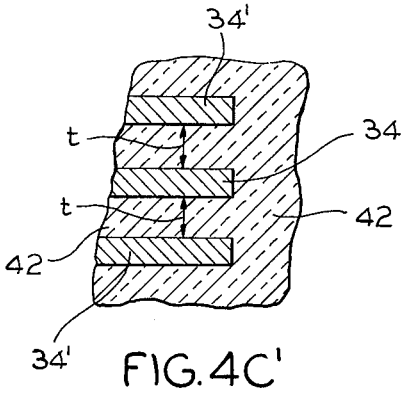

A laminated ceramic varistor according to the first preferred embodiment of the present invention, manufactured through use of the above-described process, is shown in detail in FIGS. 4A to 4C. More particularly, within an integrated ceramic sintered body 42 (having dimensions of, a=6 mm, b=5 mm and, for example, e=1.5 mm) are provided internal electrodes 34 and 34' having dimensions of c=5 mm and d=3 mm. The portions where the electrodes 34 and 34' are opposed to each other serve as effective portions. As a matter of course, on the side surfaces 43 where the external electrodes are not provided, the internal electrodes 34 and 34' are not exposed. Furthermore, the gap distance between the internal electrodes, that is, the elementary layer thickness t shown in FIG. 4C' can be made as thin as 10μ with good reproducibility and good controllability.

The electric characteristics such as α, Vi, etc. of this preferred embodiment were calculated by measuring the voltage-current characteristic with a D.C. voltage or by a pulse supplied from a curve tracer. The value of the leakage current $i_R$ was evaluated as a current value at a voltage of 60% of $V_{1mA}$. In addition, with regard to the power loading characteristics, after a power of 0.5 W was applied to the varistor for 500 hours within a thermostat held at 80° C., the temperature was again lowered to a room temperature. Then $V_{10\,\mu A}$ was measured to calculate the rate of variation, and thereby an evaluation of the characteristics was made. Regarding the surge withstanding characteristics, after an impulsive waveform pulse of 50 A (current waveform of 10×200 μsec) was repeatedly applied 10000 times at intervals of one second, $V_{10\,\mu A}$ was measured to calculate the rate of variation, and thereby an evaluation of the characteristics was made.

TABLE 2 and FIGS. 5 through 8 show the results which are obtained. In every sample, platinum (Pt) paste was employed as the material for the internal electrodes. However, any stable metal or alloy may be used if it has a sufficiently small electrical resistance and can serve as electrodes even after sintering (such) as, for example, Ag, Au, Pd, Ir, etc. In TABLE 2, the indication of "unit plate" represents the measured sample in the prior art which was obtained by the process shown in the right column of TABLE 1. The indication "elementary layer thickness" represents the thickness t between internal electrodes 34 and 34' shown in FIG. 4C'.

TABLE 2

(Embodiment 1)

| Sample No. | Compositions (mol %) ZnO | CoO | $MnO_2$ | $Sb_2O_3$ | $Cr_2O_3$ | Glass A (Weight %) | Type | Elementary Layer Thickness (t) (mm) | $V_{1mA}$ (V) | α | $i_R$ ($\times 10^{-6}$A) | ΔV/V10μ (%) D-C | ΔV/V10μ (%) Pulse |
|---|---|---|---|---|---|---|---|---|---|---|---|---|---|
| 1 | 95 | 1 | 1 | 2 | 1 | 10 | Laminated | 0.02 | 4.0 | 37.5 | 0.19 | −5.8 | −9.0 |
| 2 | 95 | 1 | 1 | 2 | 1 | 10 | " | 0.05 | 9.8 | 41.5 | 0.18 | −4.6 | −5.6 |
| 3 | 95 | 1 | 1 | 2 | 1 | 10 | " | 0.10 | 20.0 | 43.0 | 0.17 | −4.4 | −3.6 |
| 4 | 95 | 1 | 1 | 2 | 1 | 10 | " | 0.30 | 62.0 | 45.5 | 0.16 | −4.2 | −1.8 |
| 5 | 95 | 1 | 1 | 2 | 1 | 10 | " | 0.50 | 104.0 | 46.0 | 0.16 | −4.2 | −1.6 |
| 6 | 95 | 1 | 1 | 2 | 1 | 10 | " | 1.00 | 200.0 | 46.0 | 0.15 | −4.1 | −1.4 |
| 7 | 95 | 1 | 1 | 2 | 1 | 10 | Unit Plate | 0.30 | 130 | 25.0 | 5.0 | −13.0 | −18.0 |
| 8 | 95 | 1 | 1 | 2 | 1 | 10 | " | 0.50 | 185 | 41.5 | 0.54 | −7.8 | −8.6 |
| 9 | 95 | 1 | 1 | 2 | 1 | 10 | " | 1.00 | 400 | 46.0 | 0.18 | −3.8 | −2.0 |

Laminated Type: present invention
Unit Plate Type: prior art

Figure 5:
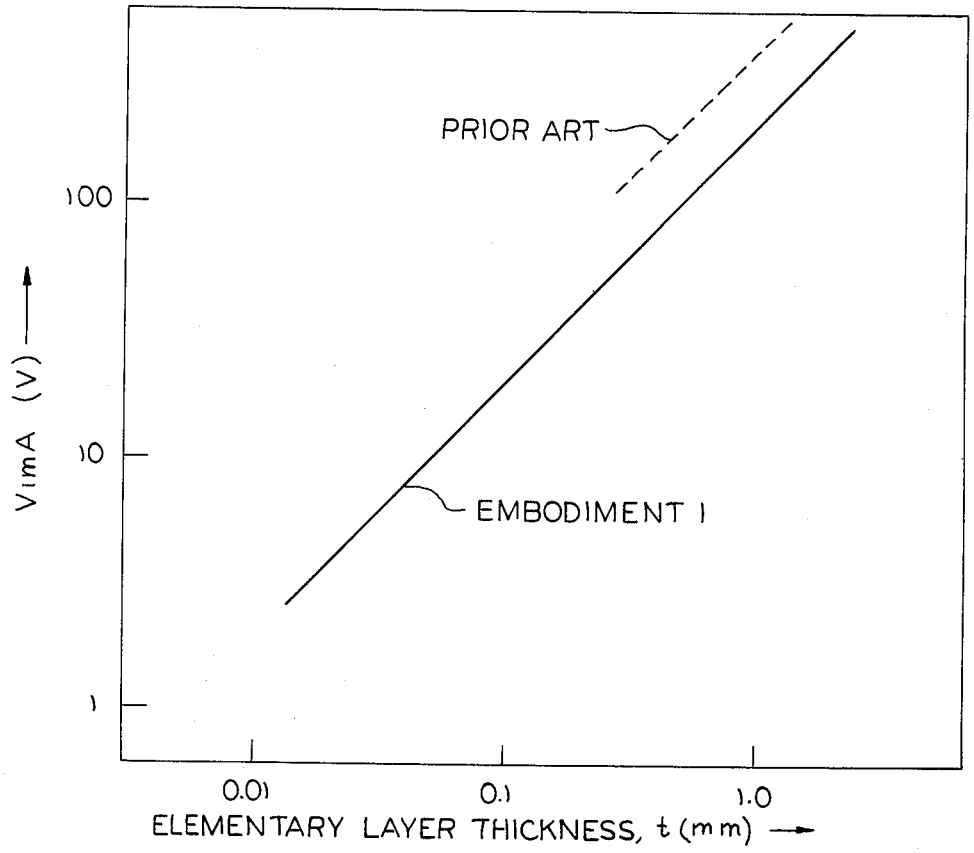

FIG. 5 shows the variation of $V_{1mA}$ when the layer thickness t for each layer is varied while maintaining the other conditions constant. A dotted line shows the variations for unit plate products in the prior art and a solid line shows the variations for laminated products of the embodiment 1. As will be apparent from this figure, with respect to the same element thickness, the value of $V_{1mA}$ is far smaller for a laminated product than it is for a unit plate product. In addition, for unit plate products, a thickness of 0.3 mm is the lower limit as described previously and it is difficult to reduce the thickness to less than this value, whereas in the method employing lamination according to the present invention even an element thickness of 0.1 mm or less can be easily manufactured.

Figure 6:
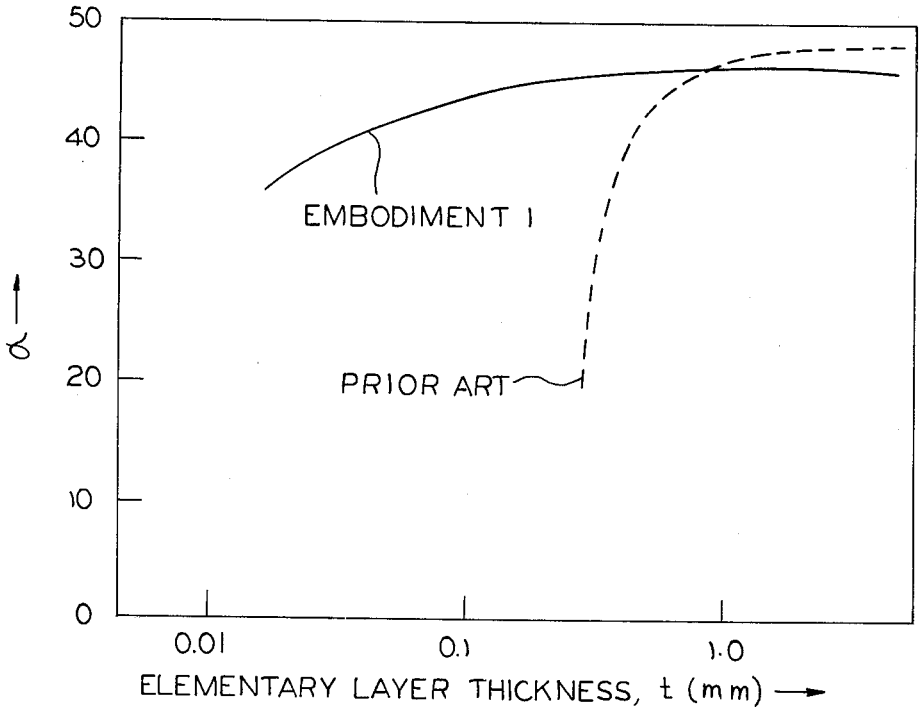

FIG. 6 shows the variation of the nonlinearity coefficient α with a variation of the element thickness t for each layer. When the thickness becomes 0.5 mm or more, the coefficients of unit plate products represented by a dotted line and the coefficients of laminated products represented by a solid line present little difference therebetween. However, in the unit plate products the coefficient α is extremely reduced at an element thickness which is smaller than this value, which means that the performance as a voltage-dependent nonlinear resistor is greatly degraded. On the other hand, for laminated products, an excellent value of about 40 for the coefficient α can be presented even at a thickness of about 0.02 mm.

Figure 7:
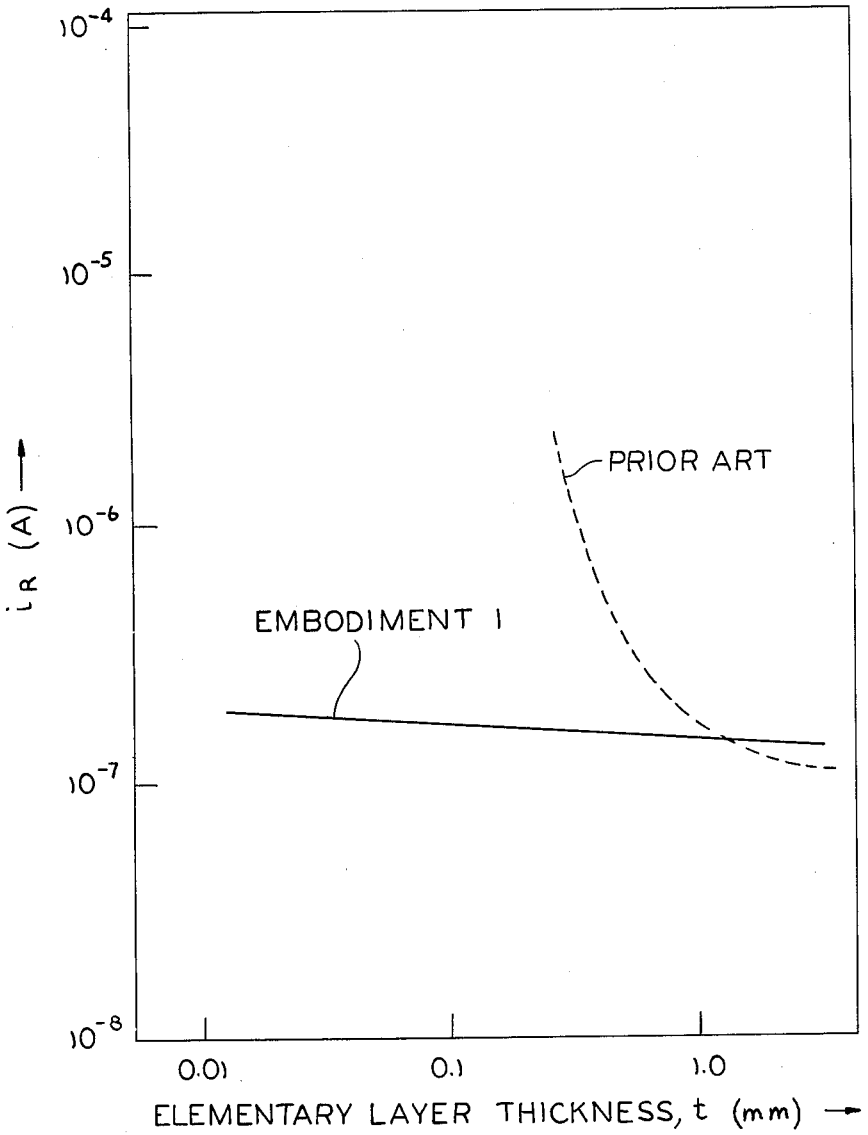

FIG. 7 shows leakage current $i_R$ characteristics. As will be apparent from this figure, the laminated product according to the present invention, as represented by a solid line, has an extremely improved leakage current at a small element thickness in comparison to the leakage current for the unit plate product, represented by a dotted line.

Figure 8:
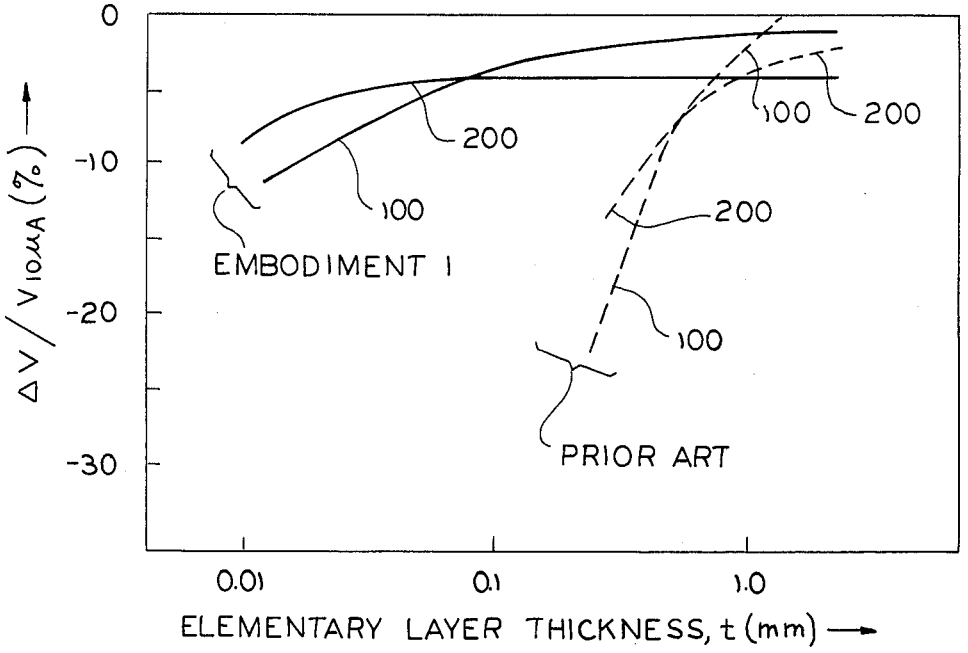

FIG. 8 shows rates of variation $\Delta V/V_{10\,\mu A}$ of the voltage for a current value of 10 μA caused by power loading (characteristics 200) and surge application (characteristics 100), respectively. In the case of unit plate products, when the thickness becomes thin, the absolute value of $\Delta V/V_{10\,\mu A}$ becomes extremely large, whereas in the case of laminated products it has only a small variance. With respect to both the characteristics 100 and the characteristics 200, solid lines represent the case of the laminated products according to the present invention, while dotted lines represent the unit plate products in the prior art.

As will be obvious from the results of the above-described measurement, the laminated ceramic varistor according to the present invention has very different characteristics from the characteristics of the unit plate products, which is obtained by simply piling and bonding base bodies and which present voltage-dependent nonlinearity. In other words, the excellent results appearing in TABLE 2 in FIGS. 5 through 8 were first obtained by the laminated products according to the present invention.

These remarkable differences in characteristics are caused by the differences in structures and in manufacturing processes, that is, by the distinction of the laminated products according to the present invention. These products have such a structure that all the internal electrodes are embedded within the base body presenting voltage-dependent nonlinearity and furthermore the structure of these products is formed through one sintering process. Whereas the unit plate products in the prior art are produced by applying electrodes to a base body, presenting voltage-dependent nonlinearity, and simply piling such base bodies.

It is to be noted that, as will be apparent from the principle of the present invention, for the base body any material that can present voltage-dependent nonlinearity after sintering could be employed. As a matter of course, for the internal electrodes, any conductive material could be used as long as its electric conductivity does not significantly deteriorate due to changes in the material caused by sintering.

Next, experiments were conducted with respect to the following contrast samples while maintaining the other conditions identical to those shown in TABLE 2:

(a) samples were manufactured by making use of the raw sheet technique, but 10 raw sheets having internal electrodes formed thereon were bonded with a binder so that the internal electrodes may be exposed to the side surfaces.

(b) samples were manufactured into a laminated type by making use of the raw sheet technique, but internal electrodes may be exposed on the side surfaces. The results of the experiments are shown in TABLE 3.

TABLE 3

| Sample No. | Form of the sample | Elementary Layer Thickness (t) (mm) | $V_{1mA}$ (V) | $\alpha$ | $i_R$ ($\times 10^{-6}$A) | $\Delta V/V10\mu$ (%) D-C | Pulse |
|---|---|---|---|---|---|---|---|
| 2 | Identical sample with No. 2 of TABLE 2 | 0.05 | 9.8 | 41.5 | 0.18 | −4.6 | −5.6 |
| 2a | Piling and bonding ten raw-sheets, the internal electrodes are exposed on the side surface | 0.05 | 9.2 | 15.5 | 10.5 | −16.0 | −18.5 |
| 2b | Laminated type by making use of the raw sheet technique, but internal electrodes are exposed on the side surface | 0.05 | 9.9 | 30.4 | 0.29 | −16.5 | −13.9 |
| 4 | Identical sample with No. 4 of TABLE 2 | 0.3 | 62.0 | 45.5 | 0.16 | −4.2 | −1.8 |
| 4a | Identical sample with sample 2a of this table | 0.3 | 63.5 | 27.0 | 3.0 | −14.0 | −16.4 |
| 4b | Identical sample with sample 2b of this table | 0.3 | 63.4 | 30.4 | 0.35 | −10.3 | −15.0 |

Comparing the data for the layer thickness t of 0.3 mm in the above table with the data for the sample No. 4 in TABLE 2, and the data for the layer thickness t of 0.05 mm with the data for the sample No. 2 in TABLE 2, the following results are derived:

(1) For the same thickness t of each sheet, the value of $V_{1mA}$ is reduced to about one-half by employing raw sheets.

(2) Samples formed by employing raw sheets and integrating them in a laminated type have the coefficient $\alpha$ of 30 or more, whereas samples formed by piling and bonding all have the coefficient $\alpha$ of less than 30 which is equal to 27 at the maximum.

(3) Comparing samples having internal electrodes exposed on the side surfaces with samples having internal electrodes entirely embedded, the value of $V_{1mA}$ has little difference therebetween, but the value of the coefficient $\alpha$ is somewhat larger for the latter samples. However, with regard to the rate of variation $\alpha V/V_{10\,\mu A}$ of the voltage for a current value of 10 $\mu$A measured by a D.C. current test or a pulse test, for every sample having the internal electrodes entirely embedded the rate is 10% or less, whereas for samples having the internal electrodes exposed on the side surfaces the rate exceeds 10%.

(4) For samples manufactured according to the prior art technique, the voltage variation rate ($\Delta V/V_{10\,\mu A}$) is too large, and every example has a voltage variation rate of 10% or more.

(5) In the case of integrating the raw sheets by sintering them after lamination, samples having internal electrodes not exposed on the side surfaces present higher values of the coefficient $\alpha$. In the same case, the voltage variation rate ($\Delta V/V_{10\,\mu A}$) is 10% or less for the samples having the internal electrodes not exposed on the side surfaces, but it exceeds 10% for the samples having the internal electrodes exposed on the side surfaces.

(6) Even if a sintered body of 0.3 mm or less in thickness is manufactured by making use of the raw sheet technique, according to the method of bonding such sintered bodies with a binder, only the coefficient $\alpha$ is lower than that in the prior art. This implies that when a thin row sheet of 0.3 mm or less in thickness is sintered, since the temperature is 950° C. or higher, the changes in nature of the sintered body caused by an evaporation of the principal component ZnO and the additives, cannot be avoided.

EMBODIMENT 2

A raw material containing zinc oxide (ZnO) having a purity of 99% or higher as a principal component, is mixed with cobalt oxide (CoO), manganese oxide ($MnO_2$), antimony oxide ($Sb_2O_3$), chromium ($Cr_2O_3$) and bismuth oxide ($Bi_2O_3$) in the proportions of 1.0 mol%, 1.0 mol%, 2.0 mol%, 1.0 mol% and 0~0.6 mol% as calculated in terms of the respective oxides.

Further, this mixture was combined with lead zinc borosilicate glass powder, having the composition C in TABLE 12, of 10% by weight with respect to the total weight of the oxides. The combined mixture was subjected to a treatment which was similar to the treatment in the Embodiment 1. Ten sheets were laminated, and formed into samples. Platinum (Pt) of 7 μm thickness was employed for the internal electrodes. The thickness of each raw sheet was regulated to have a layer thickness t of 50μ after sintering. Results of the measurement for these samples are shown in FIG. 9, in which solid lines represent the characteristics of the laminated products according to the present invention, while dotted lines represent those of the unit plate products in the prior art having the same compositions, thickness, number of internal electrodes and surface area as the embodiment 2.

Figure 9:
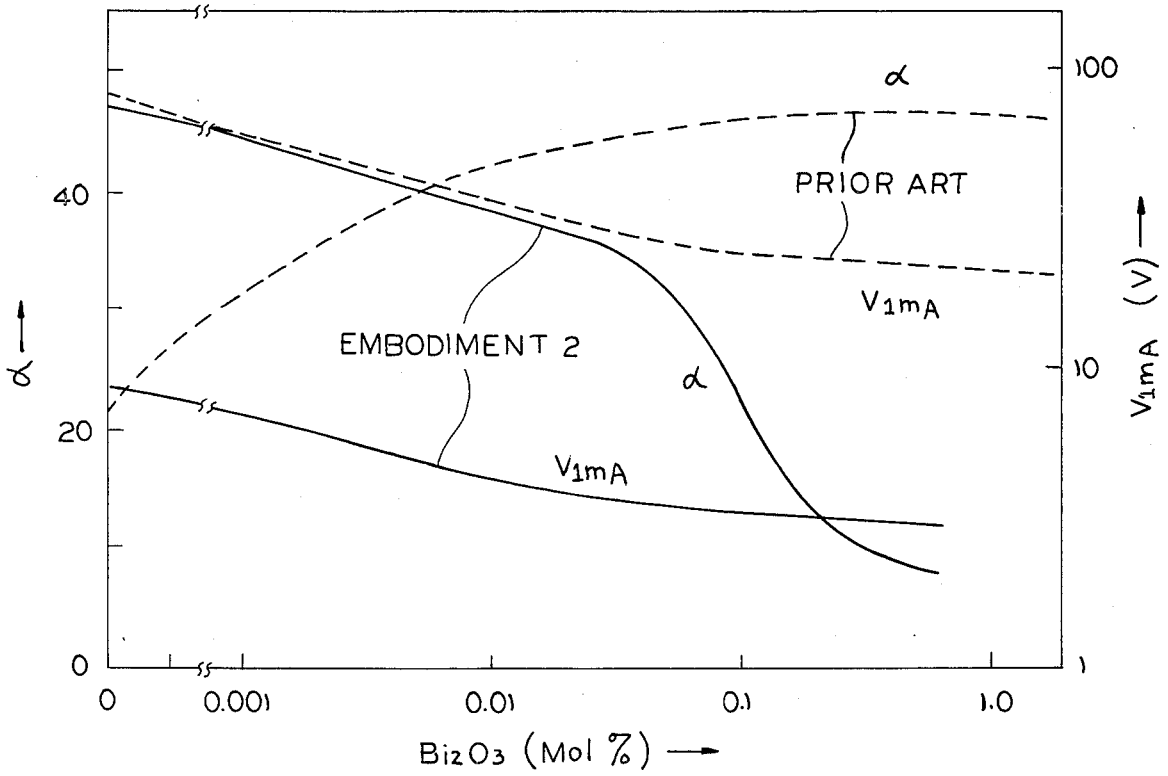
FIG. 9 is a diagram showing the characteristics of the second preferred embodiment of the present invention, as compared with the corresponding characteristics of the prior art.

As will be apparent from FIG. 9, it has been discovered that if the amount of the addition of Bi exceeds 0.05 mol%, then the nonlinearity coefficient $\alpha$ is lowered abruptly. From the above experimental results, it is apparent that the amount of bismuth oxide used as an additive is required to be 0.05 mol% or less. In FIG. 9, dotted lines represent the experimental results for unit plate products, in which the nonlinearity coefficient $\alpha$ gradually rises as an amount of bismuth increases. Obviously these results are different from the experimental results for the laminated products according to the present invention, and thus the effects of bismuth are clearly different for the unit plate products as compared to the laminated products.

This difference is apparently caused by the difference in structure and the manufacturing process for the laminated products, according to the present invention, and the unit plate products in the prior art. It is thought that the difference lies in the structure in which internal electrodes are entirely embedded in a base body. As a result of a microscopic enamination of cross-sections of samples for seeking for the cause of the difference, it has been discovered that in samples containing larger amounts of bismuth, platinum disposed as internal electrodes reacts with bismuth and hence the role of the internal electrodes is not achieved. This phenomenon is not limited to platinum, but it would similarly occur in the case Pd, Au, Ag or alloys of these metals are employed as internal electrodes.

From the above-mentioned, it is seen that from the principle of the present invention, in order to obtain excellent characteristics of the laminated ceramic varistors, it is necessary to limit the amount of additional bismuth to 0.05 mol% or less, as calculated in terms of the oxide.

EMBODIMENT 3

A starting material was a mixture consisting of zinc oxide (ZnO) having a purity of 99% or higher, cobalt oxide (CoO), lanthanum oxide ($La_2O_3$), praseodymium oxide ($Pr_2O_3$), cerium oxide ($CeO_2$), neodymium oxide ($Nd_2O_3$), tin oxide ($SnO_2$) and lead zinc borosilicate glass powder. These respective oxides were mixed in the proportions shown in TABLE 4. The same process and the same internal electrodes, as Embodiment 1, were employed. Ten raw sheets were alternately laminated similarly to Embodiment 1, and the characteristics of the respective samples were measured.

TABLE 4

(Embodiment 3)

| Sample No. | Compositions (mol %) ZnO | CoO | $La_2O_3$ | $Pr_2O_3$ | $CeO_2$ | $Nd_2O_3$ | $SnO_2$ | Glass | Elementary Layer Thickness (t) (mm) | $\alpha$ | $V_{1mA}$ (V) | $i_R$ (μA) |
|---|---|---|---|---|---|---|---|---|---|---|---|---|
| 1 | 94.0 | 1.0 | 1.0 | 1.0 | 1.0 | 1.0 | 1.0 | — | 200 | 25 | 45 | 0.25 |
| 2 | 94.0 | 1.0 | 1.0 | 1.0 | 1.0 | 1.0 | 1.0 | — | 100 | 10 | 25 | 0.18 |
| 3 | 94.0 | 1.0 | 1.0 | 1.0 | 1.0 | 1.01 | 1.0 | — | 70 | 13 | 13 | 0.20 |
| 4 | 94.0 | 1.0 | 1.0 | 1.0 | 1.0 | 1.0 | 1.0 | — | 50 | 12 | 12.5 | 0.19 |
| 5 | 94.0 | 1.0 | 1.0 | 1.0 | 1.0 | 1.0 | 1.0 | — | 30 | 11 | 8.4 | 0.22 |
| 6 | 94.0 | 1.0 | 1.0 | 1.0 | 1.0 | 1.0 | 1.0 | — | 20 | 15 | 5.2 | 0.22 |
| 7 | 94.0 | 1.0 | 1.0 | 1.0 | 1.0 | 1.0 | 1.0 | A | 100 | 25 | 22 | 0.15 |
| 8 | 94.0 | 1.0 | 1.0 | 1.0 | 1.0 | 1.0 | 1.0 | A | 70 | 26 | 12.3 | 0.11 |
| 9 | 94.0 | 1.0 | 1.0 | 1.0 | 1.0 | 1.0 | 1.0 | A | 50 | 28 | 10.3 | 0.21 |
| 10 | 94.0 | 1.0 | 1.0 | 1.0 | 1.0 | 1.0 | 1.0 | A | 30 | 25 | 7.5 | 0.13 |
| 11 | 94.0 | 1.0 | 1.0 | 1.0 | 1.0 | 1.0 | 1.0 | A | 20 | 19 | 4.2 | 0.14 |
| 12 | 94.0 | 1.0 | 1.0 | 1.0 | 1.0 | 1.0 | 1.0 | B | 50 | 30 | 11.5 | 0.13 |
| 13 | 94.0 | 1.0 | 1.0 | 1.0 | 1.0 | 1.0 | 1.0 | C | 50 | 26 | 12.0 | 0.15 |
| 14 | 94.0 | 1.0 | 1.0 | 1.0 | 1.0 | 1.0 | 1.0 | D | 50 | 32 | 13.2 | 0.23 |

In TABLE 4, rows NO. 1 to NO. 6 represent characteristics of samples added with no glass, while rows NO. 7 to NO. 14 represent characteristics of samples with added glass of 10% by weight with respect to the total weight of the oxides. Both of these groups of samples present varistor characteristics. This table shows the fact that nonlinearity is improved by an addition of glass.

Figure 10:
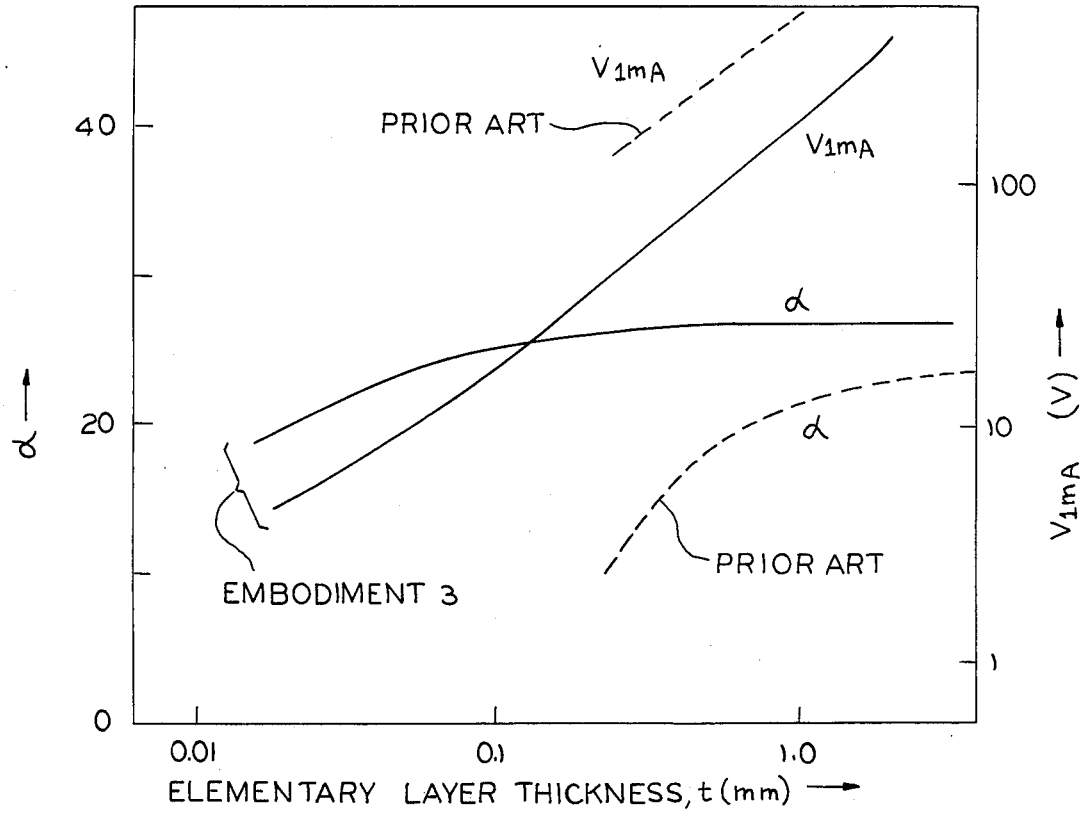
FIGS. 10 and 11 are diagrams showing the characteristics of the third preferred embodiment of the present invention as compared with the corresponding characteristics of the prior art.
Figure 11:
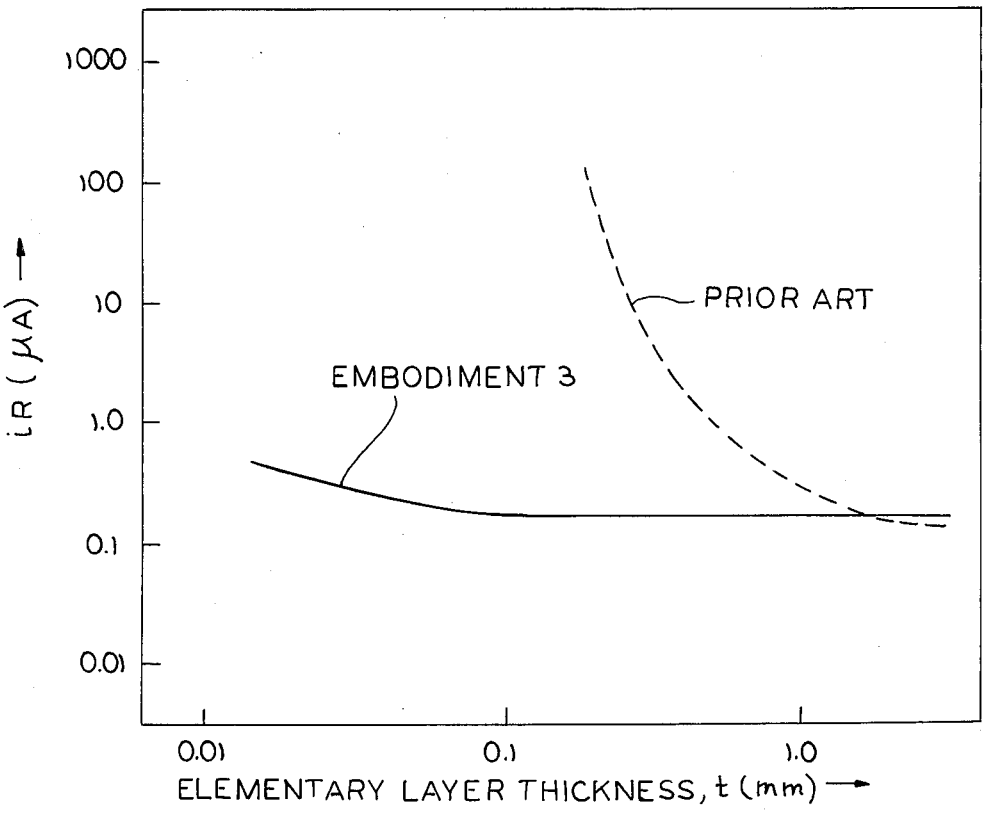

FIGS. 10 and 11 are graphs which the characteristics measured with respect to a series of laminated products having the successively varied elementary layer thickness. The compositions have added glass, as indicated in rows NO. 7 to NO. 11, respectively. The graphs also give the characteristics with respect to unit plate products having the same configurations as the respective laminated products. The unit plate products of the prior art are manufactured by cutting and grinding a base body presenting a voltage-dependent nonlinearity which has to be preliminarily produced through sintering, into sheets having a predetermined thickness, and then piling the sheets with electrodes applied thereon. It is to be noted that the different compositions of glass are marked by symbols A, B, C and D in both TABLE 4 and TABLE 12.

As will be apparent from FIG. 10, the value of $V_{1mA}$ for the unit plate product in the prior art represented by a dotted line is larger than the value of $V_{1mA}$ for the laminated product according to the present invention represented by a solid line. With regard to the nonlinearity coefficient $\alpha$, the value for the laminated product is larger than the value for the unit plate product. In addition, in the case of unit plate product, it is difficult to manufacture a varistor having an elementary layer thickness of 0.3 mm or less. In the laminated products, even a varistor having an elementary layer thickness of 0.1 mm or less can be easily manufactured and yet the nonlinearity coefficient $\alpha$ can be held at a large value. In FIG. 11 also, a solid line represents a leakage current $i_R$ for the laminated products according to the present invention, while a dotted line represents the same leakage current for the unit plate products in the prior art.

EMBODIMENT 4

A process for manufacturing a laminated ceramic varistor that is different from Embodiment 1 is illustrated in TABLE 5. In the following, the description will be made in detail specifically with respect to the process for manufacturing a laminated ceramic varistor that is different from Embodiment 1.

With regard to a starting material, ferric oxide ($Fe_2O_3$), titanium oxide ($TiO_2$), zinc oxide (ZnO), lanthanum oxide ($La_2O_3$), cerium oxide ($CeO_2$), manganese oxide ($MnO_2$), antimong oxide ($Sb_2O_3$), lead oxide (PbO) and glass were first weighed in predetermined proportions calculated in terms of the respective oxides as shown in TABLE 6. These materials were mixed, with the aid of pure water, in a ball mill for 36 hours. Subsequently the mixture was filtered, dried and provisionally baked at 600° C.~850° C. for 2 hours. After the provisional baking, it was again crushed into powder, which was dispersed jointly with an organic binder in a solvent, into a paste form.

This ceramic paste was printed on an organic film through a screen printing process so as to form a rectangular sheet of 60 mm×40 mm, and then it was dried. After drying, an internal electrode paste of gold, platinum, palladium, silver or an alloy consisting of two or more of these metals was printed on the dried sheet through a screen printing process. After the internal electrodes were dried, ceramic paste was again printed thereon, through a screen printing process.

After this sheet was dried, internal electrodes having a predetermined dimension were printed through a screen printing process in a pattern displaced by 1 mm in one direction with respect to the last applied internal electrode pattern by making use of a paste of gold, platinum, palladium, silver or an alloy consisting of two or more of these metals. The aforementioned operations were carried out alternately and repeatedly, and thereby internal electrodes and ceramic paste sheets were laminated. After a predetermined number (ten layers in this embodiment) of layers had been laminated and dried, the laminated assembly was peeled off the organic film, cut by means of a cutter, and sintered at 950° C.~1300° C. for one hour. Then silver electrodes were applied by painting onto the opposite side surfaces where the internal electrodes were exposed, and baked at 600° C. The varistor characteristics such as $\alpha$, Vi, etc. were calculated from the data obtained by measuring voltage-current characteristics with a DC current or a pulse supplied from a curve tracer. The results are shown in TABLE 6 and FIG. 12.

TABLE 5

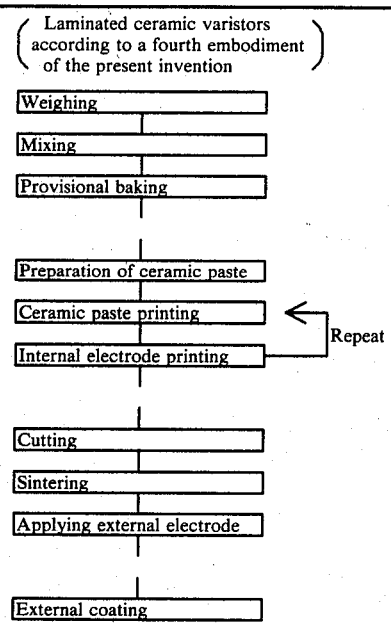

TABLE 6

(Embodiment 4)

| Sample No. | Compositions (mol %) $Fe_2O_3$ | $TiO_2$ | ZnO | $La_2O_3$ | $CeO_2$ | $MnO_2$ | $Sb_2O_3$ | PbO | Glass A (Wt%) | $\alpha$ | $V_{1mA}$ (V) |
|---|---|---|---|---|---|---|---|---|---|---|---|
| 1 | 96.0 | 1.0 | 1.0 | 1.0 | 1.0 | — | — | — | 10 | 8 | 0.5 |
| 2 | 96.0 | 1.0 | 1.0 | 1.0 | — | 1.0 | — | — | 10 | 9 | 0.8 |
| 3 | 96.0 | 1.0 | 1.0 | 1.0 | — | — | 1.0 | — | 10 | 10 | 1.0 |
| 4 | 96.0 | 1.0 | 1.0 | 1.0 | — | — | — | 1.0 | 10 | 8 | 0.8 |
| 5 | 95.0 | 1.0 | 1.0 | 1.0 | 1.0 | — | — | 1.0 | 0 | 15 | 1.5 |
| 6 | 95.0 | 1.0 | 1.0 | 1.0 | 1.0 | — | — | 1.0 | 0.1 | 6 | 0.5 |
| 7 | 95.0 | 1.0 | 1.0 | 1.0 | 1.0 | — | — | 1.0 | 1 | 15 | 1.5 |
| 8 | 95.0 | 1.0 | 1.0 | 1.0 | 1.0 | — | — | 1.0 | 5 | 16 | 3.5 |
| 9 | 95.0 | 1.0 | 1.0 | 1.0 | 1.0 | — | — | 1.0 | 20 | 18 | 3.0 |
| 10 | 95.0 | 1.0 | 1.0 | 1.0 | 1.0 | — | — | 1.0 | 50 | 10 | 2.0 |
| 11 | 95.0 | 1.0 | 1.0 | 1.0 | 1.0 | — | — | 1.0 | 60 | 6 | 0.5 |

For the material of the internal electrodes, platinum (Pt) was employed. The results shown in TABLE 6 were obtained with respect to samples in which each elementary layer thickness was 50$\mu$ and ten such elementary layers were laminated. As will be apparent from TABLE 6, at the glass content was 1% by weight to 50% by weight with respect to the total weight of the respective oxides. The nonlinearity coefficient $\alpha$ presents a relatively good value of ten or higher.

Figure 12:
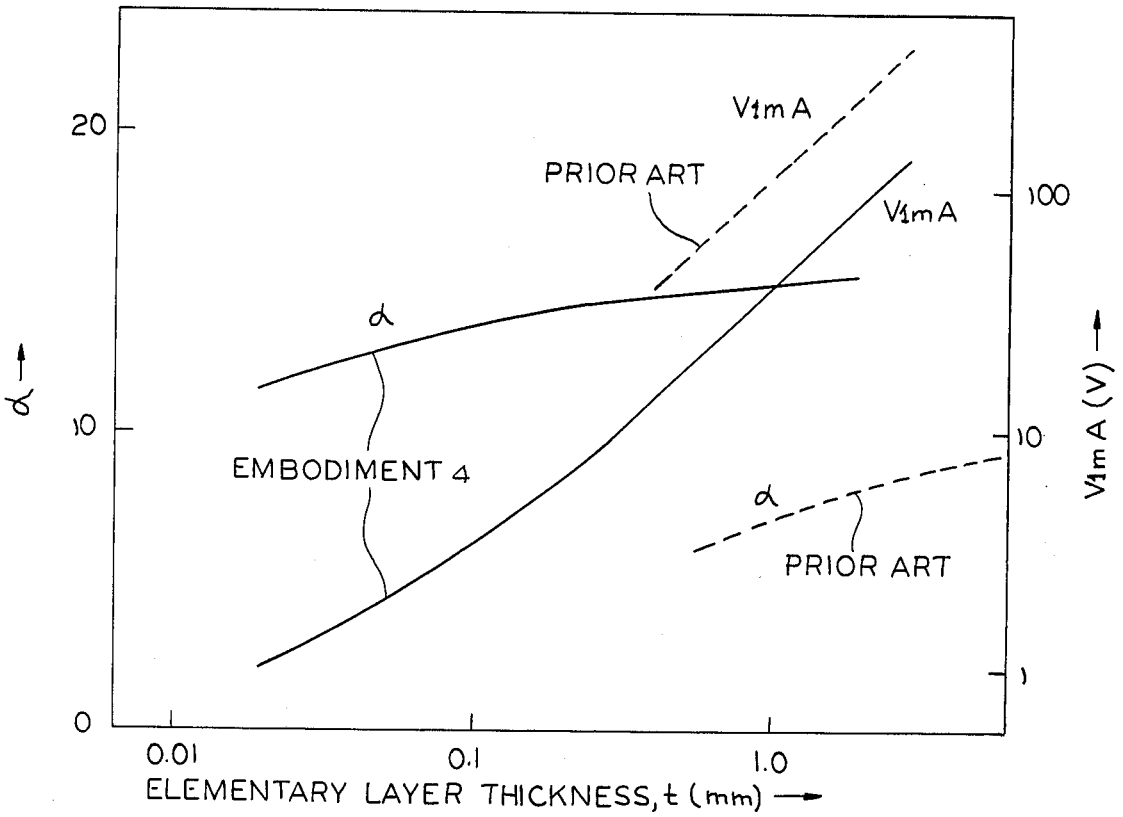
FIG. 12 is a diagram showing the characteristic of the fourth preferred embodiment of the present invention, as compared with the corresponding characteristics of the prior art.

Results of an investigation of varistor characteristics carried out by varying the elementary layer thickness with respect to Sample NO. 5 in TABLE 6, are shown in FIG. 12. Dotted lines represent the results obtained with respect to unit plate products which were prepared by preliminarily sintering a ceramic sheet having the same composition as Sample NO. 5, grinding the sintered sheet into sheet pieces having the same configuration as the elementary layer of the laminated product, applying electrodes to the sheet pieces and piling such sheet pieces. Whereas, solid lines represent the results obtained with respect to the laminated products manufactured through the process according to the present invention.

As will be apparent from FIG. 12, among the varistor characteristics of the laminated products according to the present invention represented by solid lines, the value of $V_{1mA}$ is lower than that of the unit plate products in the prior art represented by dotted lines. In addition, in the unit plate products, the value of the nonlinear coefficient $\alpha$ is ten or less. If the elementary layer thickness becomes thin, it is remarkably lowered, whereas in the case of the laminated products, the value of $\alpha$ is as large as about ten even at the thickness of 0.1 mm.

In the unit plate products, due to the limitation in the manufacturing technique as described previously, a varistor having an elementary layer thickness of 0.3 mm or less cannot be manufactured. Whereas in the case of the laminated products, a varistor having an elementary layer thickness of about 10$\mu$ can be easily manufactured. Accordingly, it is easy to lower the characteristic voltage $V_{1mA}$ to 10 V or less while maintaining the nonlinearity constant $\alpha$ at a large value.

It has been proven that the respective characteristics shown in TABLE 6 and FIG. 12 are the same as those obtained with respect to varistors manufactured through the manufacturing process described in connection to Embodiment 1. Therefore, it is obvious that the electric characteristics of the manufactured varistors are independent of the variety of the manufacturing processes for forming the laminated structure, and hence any of the inventive manufacturing processes is available.

EMBODIMENT 5

A starting material included a mixture consisting of ZnO, having a purity of 99% or higher, CoO, $MnO_2$, $TiO_2$, $SnO_2$, NiO, CuO, $Fe_2O_3$, $Bi_2O_3$, $La_2O_3$, $Pr_2O_3$ and $CeO_2$. These respective oxides were in the proportions shown in TABLE 7, and the same process, the same figure and the same internal electrodes as Embodiment 1 were employed. The characteristics of the respective samples are shown in TABLE 8.

TABLE 7

(Embodiment 5)

| Sample No. | Compositions (mol %) ZnO | CoO | $MnO_2$ | $Cr_2O_3$ | $TiO_2$ | $SnO_2$ | NiO | CuO | $Fe_2O_3$ | $Bi_2O_3$ | $La_2O_3$ | $Pr_2O_3$ | $CeO_2$ |
|---|---|---|---|---|---|---|---|---|---|---|---|---|---|
| 1 | 94 | 1 | 1 | — | 1 | — | — | — | — | — | — | — | — |
| 2 | 94 | 1 | 1 | — | — | 1 | — | — | — | — | — | — | — |
| 3 | 94 | 1 | 1 | — | — | — | 1 | — | — | — | — | — | — |
| 4 | 94 | 1 | 1 | — | — | — | — | 1 | — | — | — | — | — |
| 5 | 94 | 1 | 1 | — | — | — | — | — | 1 | — | — | — | — |
| 6 | 94.99 | 1 | 1 | — | — | — | — | — | — | 0.01 | — | — | — |
| 7 | 94 | 1 | 1 | — | — | — | — | — | — | — | 1 | — | — |
| 8 | 94 | 1 | 1 | — | — | — | — | — | — | — | — | 1 | — |
| 9 | 94 | 1 | 1 | — | — | — | — | — | — | — | — | — | 1 |
| 10 | 95 | 1 | 1 | 1 | — | — | — | — | — | — | — | — | — |

TABLE 8

(Embodiment 5)

| Sample No. | $V_{1mA}$ (V) | $\Delta$ | $i_R$ ($\times 10^{-6}$ A) |
|---|---|---|---|
| 1 | 20 | 15 | 0.25 |
| 2 | 19 | 18 | 0.23 |
| 3 | 21 | 13 | 0.22 |
| 4 | 28 | 14 | 0.24 |
| 5 | 20 | 19 | 0.26 |
| 6 | 29 | 12 | 0.23 |
| 7 | 22 | 10 | 0.24 |
| 8 | 23 | 12 | 0.21 |
| 9 | 20 | 15 | 0.20 |
| 10 | 28 | 10 | 0.20 |

Figure 13:
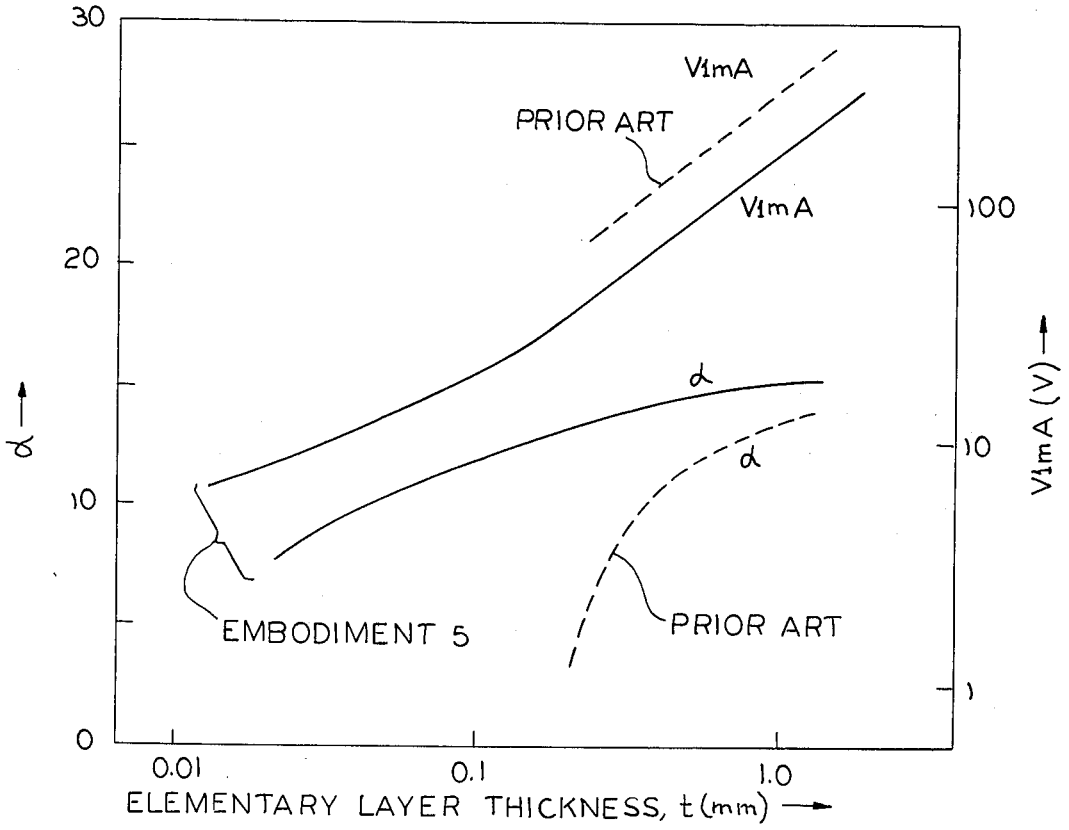
FIGS. 13 and 14 are diagrams showing the characteristics of the fifth preferred embodiment of the present invention as compared with the corresponding characteristics of the prior art.
Figure 14:
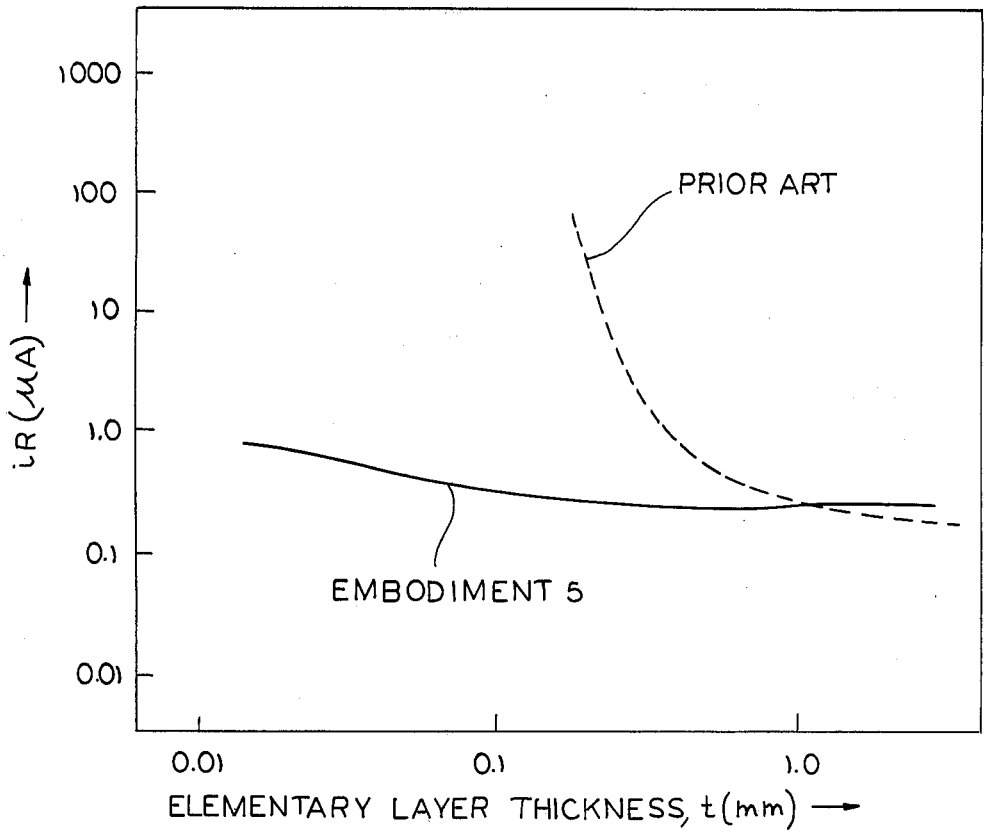

The varistor characteristics were investigated by varing the elementary layer thickness of sample NO. 10 in TABLE 7. The result of these investigations are shown in FIGS. 13 and 14. Dotted lines represent the results obtained with respect to unit plate products of the prior art and solid lines represent the results of the Embodiment 5.

EMBODIMENT 6

A starting material included a mixture consisting of titanium oxide ($TiO_2$) as main material, BaO, CoO, $La_2O_3$, PbO, NiO, $Sb_2O_3$ and glass of 0.1~60 weight percent with respect to the total weight of the oxides. These respective oxides and the glass were mixed in the proportions shown in TABLE 9, and the same process and the same internal electrodes as Embodiment 1 were employed. The characteristics of the respective samples are shown in TABLE 9.

TABLE 9

(Embodiment 6)

| Sample No. | Compositions (mol %) $TiO_2$ | $BaO_2$ | CoO | $La_2O_3$ | $PbO_2$ | $Sb_2O_3$ | NiO | Glass Symbol | wt % | $\alpha$ | $V_{1mA}$ (V) |
|---|---|---|---|---|---|---|---|---|---|---|---|
| 1 | 94.0 | 1.0 | 1.0 | 1.0 | 1.0 | — | — | — | — | 4 | 8.5 |
| 2 | 94.0 | 1.0 | 1.0 | 1.0 | 1.0 | — | — | A | 10 | 11 | 7.5 |
| 3 | 94.0 | 1.0 | 1.0 | 1.0 | 1.0 | — | — | C | 10 | 10 | 6.5 |
| 4 | 94.0 | 1.0 | 1.0 | 1.0 | — | 1.0 | — | C | 10 | 10 | 7.5 |
| 5 | 94.0 | 1.0 | 1.0 | 1.0 | — | — | 1.0 | C | 10 | 12 | 8.7 |
| 6 | 94.0 | 1.0 | 1.0 | 1.0 | 1.0 | — | — | C | 0.1 | 10 | 9.5 |
| 7 | 94.0 | 1.0 | 1.0 | 1.0 | 1.0 | — | — | C | 1 | 13 | 8.5 |
| 8 | 94.0 | 1.0 | 1.0 | 1.0 | 1.0 | — | — | C | 5 | 12 | 8.3 |
| 9 | 94.0 | 1.0 | 1.0 | 1.0 | 1.0 | — | — | C | 20 | 12 | 8.1 |
| 10 | 94.0 | 1.0 | 1.0 | 1.0 | 1.0 | — | — | C | 50 | 10 | 7.9 |

TABLE 9-continued (Embodiment 6)

| Sample No. | Compositions (mol %) $TiO_2$ | $BaO_2$ | CoO | $La_2O_3$ | $PbO_2$ | $Sb_2O_3$ | NiO | Glass Symbol | wt % | α | $V_{1mA}$ (V) |
|---|---|---|---|---|---|---|---|---|---|---|---|
| 11 | 94.0 | 1.0 | 1.0 | 1.0 | 1.0 | — | — | C | 60 | 5 | 9.5 |

Figure 15:
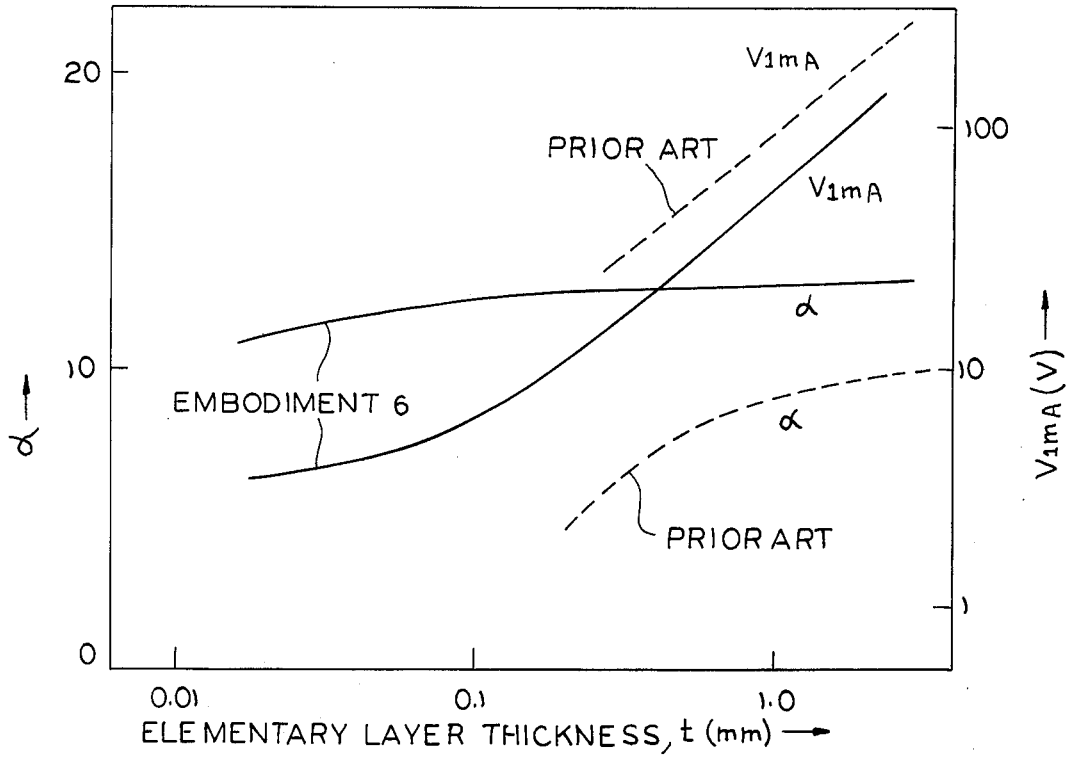
FIG. 15 is a diagram showing the characteristics of the sixth preferred embodiment of the present invention as compared with the corresponding characteristics of the prior art.

FIG. 15 shows the results of the investigation of varistor characteristics carried out by varing the elementary layer thickness of sample NO. 3 in TABLE 9. Dotted lines represent the results obtained with respect to unit plate products of the prior art and solid lines represent the result of the Embodiment 6.

EMBODIMENT 7

A starting material included a mixture consisting of ZnO having a purity of 99% or higher, CoO, $MnO_2$, $Cr_2O_3$, $TiO_2$, $SnO_2$, NiO, CuO, $Fe_2O_3$, $Bi_2O_3$, $La_2O_3$, $Pr_2O_3$ and $CeO_2$. Further lead zinc borosilicate glass of 10% by weight with respect to the total weight of the oxides was added. These respective oxides were in the proportions shown in TABLE 10, and the same process, the same figure, and the same internal electrodes as Embodiment 1 were employed. The characteristics of the respective samples are shown in TABLE 10.

TABLE 10

(Embodiment 7)

| Sample No. | Compositions (mol %) ZnO | CoO | $MnO_2$ | $Cr_2O_3$ | $TiO_2$ | $SnO_2$ | NiO | CuO | $Fe_2O_3$ | $Bi_2O_3$ | $La_2O_3$ | $Pr_2O_3$ | $CeO_2$ |
|---|---|---|---|---|---|---|---|---|---|---|---|---|---|
| 11 | 94 | 1 | 1 | — | 1 | — | — | — | — | — | — | — | — |
| 12 | 94 | 1 | 1 | — | — | 1 | — | — | — | — | — | — | — |
| 13 | 94 | 1 | 1 | — | — | — | 1 | — | — | — | — | — | — |
| 14 | 94 | 1 | 1 | — | — | — | — | 1 | — | — | — | — | — |
| 15 | 94 | 1 | 1 | — | — | — | — | — | 1 | — | — | — | — |
| 16 | 94.99 | 1 | 1 | — | — | — | — | — | — | 0.01 | — | — | — |
| 17 | 94 | 1 | 1 | — | — | — | — | — | — | — | 1 | — | — |
| 18 | 94 | 1 | 1 | — | — | — | — | — | — | — | — | 1 | — |
| 19 | 94 | 1 | 1 | — | — | — | — | — | — | — | — | — | 1 |
| 20 | 95 | 1 | 1 | 1 | — | — | — | — | — | — | — | — | — |

| Sample No. | Glass Symbol | (Wt %) | $V_{1mA}$ (V) | α | $i_R$ (X10$^{-6}$A) |
|---|---|---|---|---|---|
| 11 | A | 10 | 9 | 38 | 0.18 |
| 12 | A | 10 | 8 | 42 | 0.17 |
| 13 | A | 10 | 12 | 40 | 0.19 |
| 14 | A | 10 | 10 | 41 | 0.20 |
| 15 | A | 10 | 9 | 42 | 0.17 |
| 16 | A | 10 | 10 | 41 | 0.16 |
| 17 | A | 10 | 10 | 37 | 0.17 |
| 18 | A | 10 | 8 | 40 | 0.18 |
| 19 | A | 10 | 11 | 39 | 0.18 |
| 20 | A | 10 | 10 | 43 | 0.18 |

Figure 16:
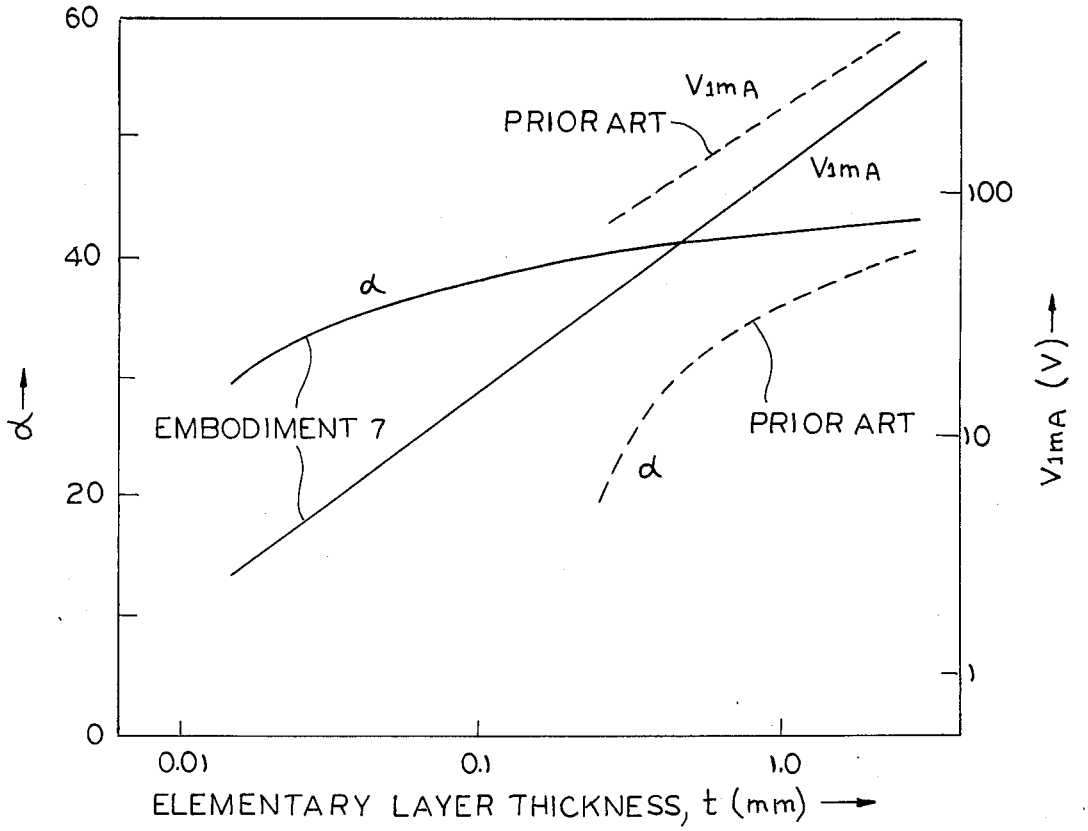
FIGS. 16 and 17 are diagrams showing the characteristics of the seventh preferred embodiment of the present invention as compared with the corresponding characteristics of the prior art.
Figure 17:
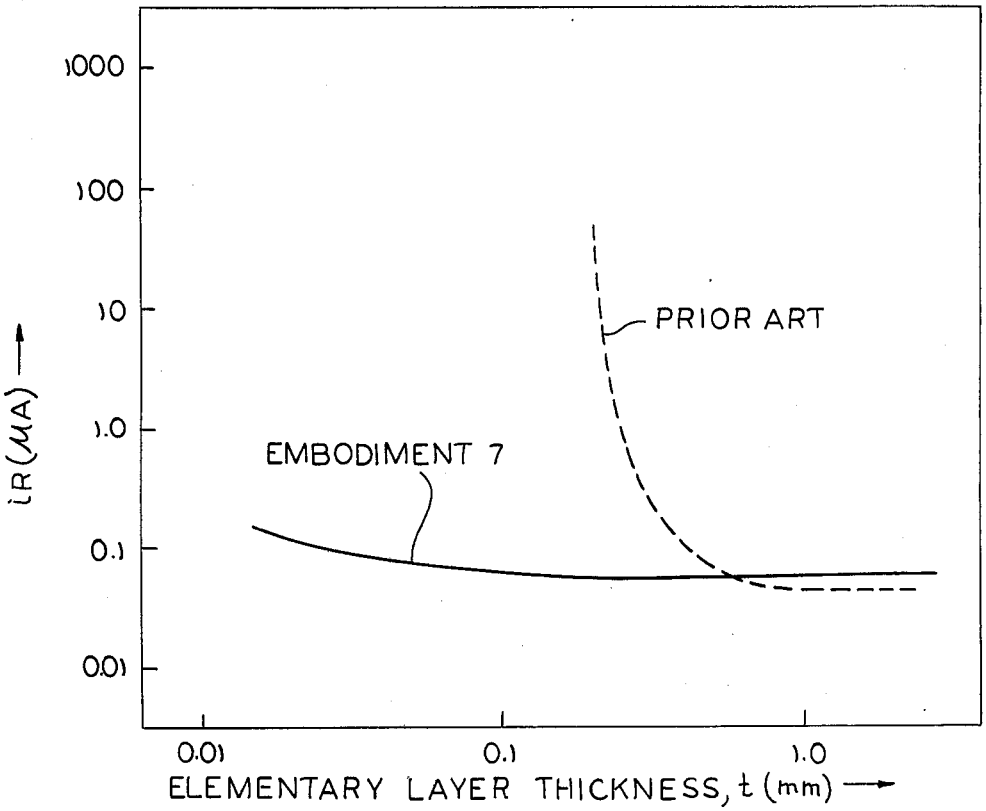

FIGS. 16 and 17 show the results of the investigation of varistor characteristics carried out by varing the elementary layer thickness of sample NO. 20 in TABLE 10. Dotted lines represent the results obtained with respect to unit plate products in the prior art and solid lines represent the results of the Embodiment 7.

EMBODIMENT 8

A starting material includes a mixture consisting of ZnO having a purity of 99% or higher, CoO, $MnO_2$, $Sb_2O_3$, $Cr_2O_3$ and lead zinc borosilicate glass of 10% by weight with respect to the total weight of the oxides. These respective oxides were in the proportions shown in TABLE 11, and the same process and the same figure as Embodiment 1 were employed. The characteristics of the respective samples are shown in TABLE 11.

TABLE 11

(Embodiment 8)

| Sample No. | Compositions (mol %) ZnO | CoO | $MnO_2$ | $Sb_2O_3$ | $Cr_2O_3$ | Glass Symbol | (Wt %) | Material of Internal Electrode | $V_{1mA}$ (V) | α | $i_R$ (×10$^{-6}$A) |
|---|---|---|---|---|---|---|---|---|---|---|---|
| 1 | 95 | 1 | 1 | 2 | 1 | A | 10 | Au | 10 | 43 | 0.17 |
| 2 | 95 | 1 | 1 | 2 | 1 | A | 10 | Ag | 11 | 42 | 0.18 |
| 3 | 95 | 1 | 1 | 2 | 1 | A | 10 | Pd | 10 | 42 | 0.18 |
| 4 | 95 | 1 | 1 | 2 | 1 | A | 10 | Pt | 10 | 48 | 0.17 |
| 5 | 95 | 1 | 1 | 2 | 1 | A | 10 | Ag—Pd | 10 | 41 | 0.16 |
| 6 | 95 | 1 | 1 | 2 | 1 | A | 10 | Pt—Rh | 11 | 44 | 0.16 |
| 7 | 95 | 1 | 1 | 2 | 1 | A | 10 | Pt—Ir | 11 | 44 | 0.15 |
| 8 | 95 | 1 | 1 | 2 | 1 | A | 10 | Pt—Mo | 9 | 42 | 0.17 |
| 9 | 95 | 1 | 1 | 2 | 1 | A | 10 | Pt—W | 9 | 40 | 0.17 |
| 10 | 95 | 1 | 1 | 2 | 1 | A | 10 | Pt—Ni | 10 | 40 | 0.16 |
| 11 | 95 | 1 | 1 | 2 | 1 | A | 10 | Pt—Fe | 10 | 41 | 0.19 |
| 12 | 95 | 1 | 1 | 2 | 1 | A | 10 | Pt—Cr | 11 | 41 | 0.17 |

The results of the investigation indicate that the materials of the internal electrode does not affect the characteristics of the present invention, in an essential manner.

EMBODIMENT 9

Figure 18:
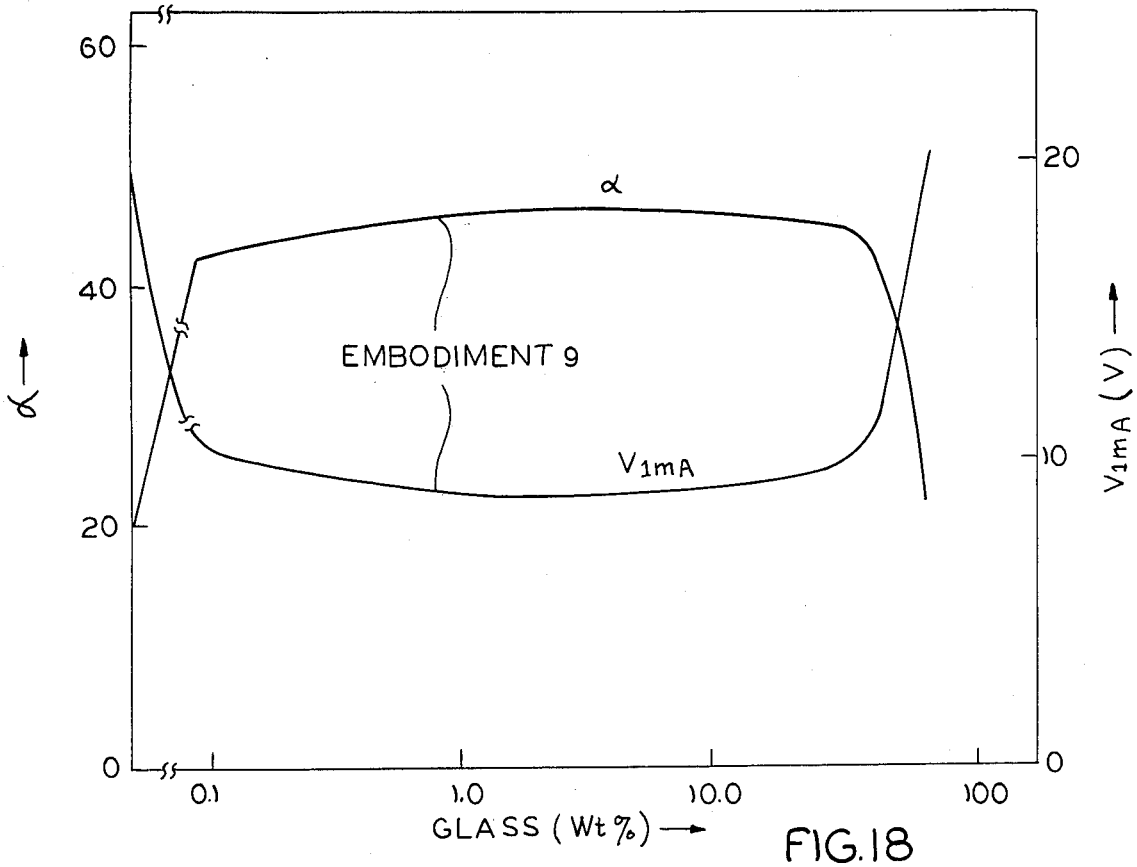
FIGS. 18 through 20 are diagrams showing the characteristics of the nineth preferred embodiment of the present invention.
Figure 19:
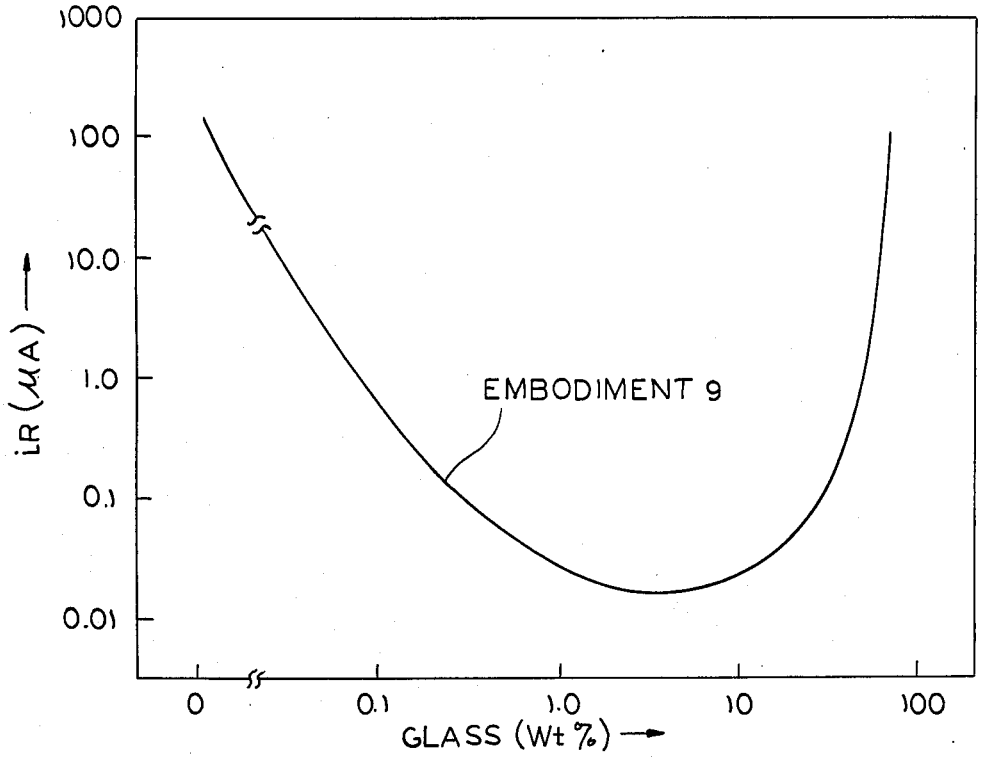
Figure 20:
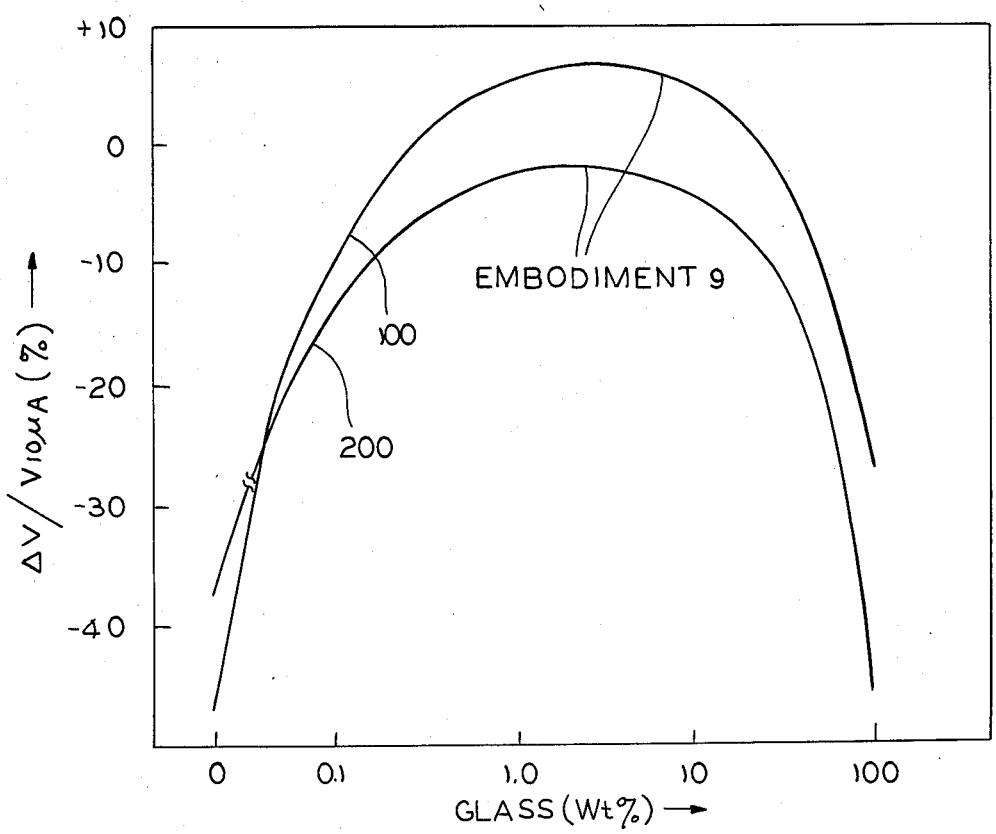

A starting material including a mixture consisting of ZnO having a purity of 99% or higher as a principal component, mixed with cobalt oxide (CoO), manganese oxide ($MnO_2$), antimony oxide ($Sb_2O_3$) and chromium oxide ($Cr_2O_3$) in the proportions of 1.0 mol%, 1.0 mol%, 2.0 mol% and 1.0 mol%, respectively, as calculated in terms of the respective oxides. Further lead zinc borosilicate glass was added, and the same process, the same internal electrode and the same figure as Embodiment 1 were employed. FIGS. 18–20 show the results of the investigation of varistor characteristics, carried out by varying the percent by weight (wt%) of the lead zinc borosilicate glass classified as A in TABLE 12, with respect to the total weight of the oxides. In FIG. 20, curves 100 and 200 represent the characteristics of surge application and power loading, respectively.

The results of the investigation represent that, the good characteristics of $\alpha$, $i_R$, and $\Delta V/V_{10\mu}$ can be obtained under the range of 0.1 ~ 50 by weight percent of the glass.

The symbols and compositions of the glass used in the various embodiments are shown in TABLE 12.

TABLE 12

| Glass symbols | Compositions (weight %) | | | |
|---|---|---|---|---|
| | $B_2O_3$ | $SiO_2$ | PbO | ZnO |
| A | 10 | 3.0 | 75 | 12 |
| B | 21.5 | 6.5 | 60 | 12 |
| C | 12 | 1.0 | 75 | 12 |
| D | 29.2 | 8.8 | 50 | 12 |

We claim:

1. A voltage-dependent nonlinear resistor comprising a sintered body having a voltage-dependent nonlinear resistance and a plurality of internal electrodes arranged in parallel with each other, each of said internal electrodes being embedded within said sintered body, except for a portion led out to an external surface.

2. A voltage-dependent nonlinear resistor comprising a ceramic base body having a voltage-dependent nonlinar resistance, a first external electrode layer on a first surface portion of said ceramic base body, a second external electrode layer on a second surface portion of said ceramic base body, a plurality of first internal electrodes, each of said first internal electrodes being connected to said first external electrode at an end portion of said first internal electrode, said first internal electrodes extending within said ceramic base body in parallel with each other, and a plurality of second internal electrodes, each of said second internal electrodes being connected to said second external electrode at an end portion of said internal electrode, said second internal electrodes extending within said ceramic base body interleaved between said first internal electrodes and in parallel with each other, each of said first and second internal electrodes being enclosed by said ceramic base body except at said end portions.

3. The voltage-dependent nonlinear resistor of claim 2, in which there is a gap distance between each of said first and second internal electrodes, the gap being not more than 0.3 mm.

4. The voltage-dependent nonlinear resistor of claim 2, in which the internal electrodes are made of at least one metal selected from a group consisting of gold, silver, palladium, platinum, rhodium, iridium, molybdenum, tungsten, nickel, iron and chromium.

5. The voltage-dependent nonlinear resistor of claim 2, in which said ceramic base body is principally composed of ZnO and contains as additives at least three other kinds of oxides selected from a group of oxides consisting of Co, Mn, Sb, Cr, Bi, Ti, Sn, Ni, Cu, Fe, La, Nd, Pr and Ce.

6. The voltage-dependent nonlinear resistor of claim 5, in which said ceramic base body includes added glass of 0.1 to 50.0% by weight with respect to the total weight of the oxides.

7. The voltage-dependent nonlinear resistor of claim 5, in which said ceramic base body contains oxide of Bi as an additive, and its content is not more than 0.05 mol %.

8. The voltage-dependent nonlinear resistor of claim 2, in which said ceramic base body is principally composed of $Fe_2O_3$.

9. The voltage-dependent nonlinear resistor of claim 8, in which said ceramic base body contains added glass in the amount of 1.0 to 50.0% by weight with respect to the total weight of the oxides.

10. The voltage-dependent nonlinear resistor of claim 2, in which said ceramic base body is principally composed ot $TiO_2$.

11. The voltage-dependent nonlinear resistor of claim 10, in which said ceramic base body contains added glass in the amount of 1.0 to 50.0% by weight with respect to the total weight of the oxides.

* * * * *

UNITED STATES PATENT AND TRADEMARK OFFICE

CERTIFICATE OF CORRECTION

PATENT NO. : 4,290,041

DATED : September 15, 1981

INVENTOR(S) : KAZUAKI UTSUMI, NOBUAKI SHOHATA & TOMEJI OHNO

It is certified that error appears in the above—identified patent and that said Letters Patent is hereby corrected as shown below:

Col. 1, Line 26, "Vima" should be --$V_{1mA}$--;

Col. 2, Line 9, "sintering the same, and in" should be --then sintering it. In--;

Col. 5, Line 38, after "Next,", insert --,--;

Col. 6, Line 60, after "obtained" insert --,--;

Col. 8, Line 3, after "such" delete ")";

Col. 8, Line 4, after "etc.", insert --)--;

Col. 10, Line 16, after "variation", "a" should be --Δ--.

Signed and Sealed this

*Nineteenth* Day of *January 1982*

[SEAL]

*Attest:*

GERALD J. MOSSINGHOFF

*Attesting Officer*

*Commissioner of Patents and Trademarks*